US006979409B2

(12) United States Patent
Chen et al.

(10) Patent No.: US 6,979,409 B2
(45) Date of Patent: Dec. 27, 2005

(54) HIGHLY QUENCHABLE FE-BASED RARE EARTH MATERIALS FOR FERRITE REPLACEMENT

(75) Inventors: Zhongmin Chen, Apex, NC (US); Benjamin R. Smith, Raleigh, NC (US); Bao-Min Ma, Cary, NC (US); James W. Herchenroeder, Gaston, IN (US)

(73) Assignee: Magnequench, Inc., Singapore (SG)

( * ) Notice: Subject to any disclaimer, the term of this patent is extended or adjusted under 35 U.S.C. 154(b) by 0 days.

(21) Appl. No.: 10/359,067

(22) Filed: Feb. 6, 2003

(65) Prior Publication Data

US 2004/0154699 A1 Aug. 12, 2004

(51) Int. Cl.[7] ..... H01F 1/057

(52) U.S. Cl. ..... 252/62.54; 148/302; 420/83; 420/121

(58) Field of Search ..... 148/302; 420/83, 420/121; 252/62.54

(56) References Cited

U.S. PATENT DOCUMENTS

| | | | |
|---|---|---|---|
| 4,264,361 A | 4/1981 | Yajima et al. | 75/230 |
| 4,402,770 A | 9/1983 | Koon | 148/31.57 |
| 4,409,043 A | 10/1983 | Koon | 148/403 |
| 4,496,395 A | 1/1985 | Croat | 75/123 E |

(Continued)

FOREIGN PATENT DOCUMENTS

| | | |
|---|---|---|
| EP | 0 229 946 A1 | 7/1987 |
| EP | 0 242 187 A1 | 10/1987 |
| EP | 0 195 219 B2 | 4/1991 |
| EP | 0 259 779 B1 | 8/1994 |

OTHER PUBLICATIONS

M. Hamano et al., "Magnetic Properties of AmorphousPhase Remaining α Fe/NdFeB Nanocomposite Alloys," Proceedings of the 12th International Workshop on Rare–Earth and Their Applications, pp 199–204, 1998.

A. Zern et al., "Microstructural Investigations of Exchange Coupled and Decouped nanocrystalline NdFeB Permanent Magnets," *Journal of Magnetism and Magnetic Materials*, 184:89–94, 1998.

(Continued)

*Primary Examiner*—John P. Sheehan
(74) *Attorney, Agent, or Firm*—Jones Day

(57) ABSTRACT

The present invention relates to highly quenchable Fe-based rare earth magnetic materials that are made by rapid solidification process and exhibit good magnetic properties and thermal stability. More specifically, the invention relates to isotropic Nd—Fe—B type magnetic materials made from a rapid solidification process with a lower optimal wheel speed and a broader optimal wheel speed window than those used in producing conventional magnetic materials. The materials exhibit remanence ($B_r$) and intrinsic coercivity ($H_{ci}$) values of between 7.0 to 8.5 kG and 6.5 to 9.9 kOe, respectively, at room temperature. The invention also relates to process of making the materials and to bonded magnets made from the magnetic materials, which are suitable for direct replacement of anisotropic sintered ferrites in many applications.

28 Claims, 12 Drawing Sheets

U.S. PATENT DOCUMENTS

| | | | | | |
|---|---|---|---|---|---|
| 4,533,408 | A | | 8/1985 | Koon | 148/103 |
| 4,558,077 | A | | 12/1985 | Gray | 523/458 |
| 4,734,131 | A | | 3/1988 | Arai et al. | 75/244 |
| 4,765,848 | A | | 8/1988 | Mohri et al. | 148/302 |
| 4,792,368 | A | | 12/1988 | Sagawa et al. | 148/302 |
| 4,802,931 | A | | 2/1989 | Croat | 148/302 |
| 4,836,868 | A | * | 6/1989 | Yajima et al. | 148/302 |
| 4,851,058 | A | | 7/1989 | Croat | 148/302 |
| 4,902,360 | A | | 2/1990 | Ma et al. | 148/302 |
| 4,902,361 | A | | 2/1990 | Lee et al. | 148/302 |
| 5,022,939 | A | | 6/1991 | Yajima et al. | 148/302 |
| 5,035,755 | A | | 7/1991 | Nathasingh et al. | 148/304 |
| 5,041,172 | A | * | 8/1991 | Tokunaga et al. | 148/302 |
| 5,055,146 | A | | 10/1991 | Narasimhan et al. | 148/302 |
| 5,056,585 | A | | 10/1991 | Croat | 164/463 |
| 5,172,751 | A | | 12/1992 | Croat | 148/101 |
| 5,209,789 | A | | 5/1993 | Yoneyama et al. | 148/302 |
| 5,213,631 | A | | 5/1993 | Akioka et al. | 148/302 |
| 5,292,380 | A | * | 3/1994 | Tanigawa et al. | 148/302 |
| RE34,838 | E | | 1/1995 | Mohri et al. | |
| 5,403,408 | A | | 4/1995 | Krause et al. | 148/302 |
| 5,411,608 | A | | 5/1995 | Hazelton et al. | 148/302 |
| 5,545,266 | A | | 8/1996 | Hirosawa et al. | 148/302 |
| 5,634,987 | A | | 6/1997 | Zhang et al. | 148/302 |
| 5,725,792 | A | | 3/1998 | Panchanathan | 252/62.54 |
| 5,772,796 | A | | 6/1998 | Kim | 148/303 |
| 6,074,492 | A | | 6/2000 | Panchanathan | 148/101 |
| 6,183,572 | B1 | | 2/2001 | Panchanathan et al. | 148/302 |
| 6,261,387 | B1 | | 7/2001 | Panchanathan | 148/302 |
| 6,302,972 | B1 | | 10/2001 | Hirosawa et al. | |
| 6,322,933 | B1 | | 11/2001 | Daiber et al. | 430/2 |
| 6,352,599 | B1 | | 3/2002 | Chang et al. | 148/302 |
| 6,478,890 | B2 | | 11/2002 | Panchanathan et al. | 148/302 |
| 6,478,891 | B1 | | 11/2002 | Arai et al. | 148/302 |
| 2001/0020496 | A1 | * | 9/2001 | Arai et al. | 148/302 |
| 2002/0084440 | A1 | * | 7/2002 | Ohmori et al. | 252/62.54 |
| 2004/0079445 | A1 | | 4/2004 | Chen et al. | |

OTHER PUBLICATIONS

T. Nishio et al., "Low Rare–Earth Nd–Fe–B Bonded Magnets With Improved Irreversible Flux Loss," *J. Appl. Phys.*, 81(8):4447–4449, Apr. 15, 1997.

G. Rieger et al., "Micromagnetic Analysis of Nanocrystalline Ga– and Nb/Mo–Doped NdFeB Permanent Magnets," *NanoStructured Materials*. 6:953–956, 1995.

B. Ma et al., "Comparison of the Improvement of Thermal Stability of NdFeB Sintered Magnets: Intrinsic and/or Microstructural," *J. Appl. Phys.*, 75(10):6628–6630, May 15, 1994.

X. Song et al., "Magnetic Properties andMicrostructure of (Nd, Dy)–Fe,Co,Tm)–/B Permanent Magnets (Tm equals AI, Nb, Mo, V)," *Journal of Xi'an Jiaotong University*, 28:99–104, 1994.

M. Q. Huang et al., "Nd–Fe–B Permanent Magnets Doped With Ce–Free Misch Metal, Dy, AI, Nb, V or Ga," 2$^{nd}$ International Workshop on Rare–Earth Magnets & Their Applications, Session 6: Posters, pp 516–527, 1993.

J. M. Le Breton et al., "Mössbauer and X–Ray Study of NdFeB Type Permanent Magnets Oxidation: Effect of AI and Nb Addition," *Journal of Magnetism and Magnetic Materials*, 101:347–348, 1991.

A. Mazany et al., "The Degradation of Polymer–Bonded Nd–Fe–B Magnets (Abstract)," *J. Appl. Phys.*, 69(8):5534, 1991.

X. Rao et al., "Thermal Stability of Nb–Doped (NdDy)(FeCoAI)B Magnets (Abstract)," *J. Appl. Phys.*, 69(8): 5534, 1991.

R. Pollard, "The Microstructure and Magnetic Properties of NdFeB Based Permanent Magnets," Thesis Submitted to the University of Salford, Feb., 1989.

R. Pollard et al., "The Effect of Quench Rate on the Microstructure and Coercivity of Some Nd–Fe–B Based Ribbons," *Journal of Magnetism and Magnetic Materials*, 75:239–242, 1988.

S. Parker et al., "Studies of Precipitation Effects in NdFeB Magnet Materials," Proceedings of the International Symposium on Physics of Magnetic Materials, pp 37–40, 1987.

* cited by examiner

HIGHLY QUENCHABLE FE-BASED RARE EARTH MATERIALS FOR FERRITE REPLACEMENT

FIELD OF THE INVENTION

The present invention relates to highly quenchable Fe-based rare earth magnetic materials that are made from a rapid solidification process and exhibit good corrosion resistance and thermal stability. The invention encompasses isotropic Nd—Fe—B type magnetic materials made from a rapid solidification process with a broader optimal wheel speed window than that used in producing conventional Nd—Fe—B type materials. More specifically, the invention relates to isotropic Nd—Fe—B type magnetic materials with remanence ($B_r$) and intrinsic coercivity ($H_{ci}$) values of between 7.0 to 8.5 kG and 6.5 to 9.9 kOe, respectively, at room temperature. The invention also relates to bonded magnets made from the magnetic materials, which are suitable for direct replacement of magnets made from sintered ferrites in many applications.

BACKGROUND OF THE INVENTION

Isotropic $Nd_2Fe_{14}B$-type melt spun materials have been used for making bonded magnets for many years. Although $Nd_2Fe_{14}B$-type bonded magnets are found in many cutting edge applications, their market size is still much smaller than that of magnets made from anisotropic sintered ferrites (or ceramic ferrites). One of the means for diversifying and enhancing the applications of $Nd_2Fe_{14}B$-type bonded magnets and increasing their market is to expand into the traditional ferrite segments by replacing anisotropic sintered ferrite magnets with isotropic bonded $Nd_2Fe_{14}B$-type magnets.

Direct replacement of anisotropic sintered ferrite magnets with isotropic bonded $Nd_2Fe_{14}B$-type bonded magnets would offer at least three advantages: (1) cost saving in manufacturing, (2) higher performance of isotropic bonded $Nd_2Fe_{14}B$ magnets, and (3) more versatile magnetizing patterns of the bonded magnets, which allow for advanced applications. Isotropic bonded $Nd_2Fe_{14}B$ type magnets do not require grain aligning or high temperature sintering as required for sintered ferrites, so the processing and manufacturing costs can be drastically reduced. The near net shape production of isotropic bonded $Nd_2Fe_{14}B$ bonded magnets also represents a cost savings advantage when compared to the slicing, grinding, and machining required for anisotropic sintered ferrites. The higher $B_r$ values (typically 5 to 6 kG for bonded NdFeB magnets, as compared to 3.5 to 4.5 kG for anisotropic sintered ferrites) and $(BH)_{max}$ values (typically 5 to 8 MGOe for isotropic bonded NdFeB magnets, as compared to 3 to 4.5 MGOe for anisotropic ferrites) of isotropic $Nd_2Fe_{14}B$-type bonded magnets also allows a more energy efficient usage of magnets in a given device when compared to that of anisotropic sintered ferrites. Finally, the isotropic nature of $Nd_2Fe_{14}B$-type bonded magnets enables more flexible magnetizing patterns for exploring potential new applications.

To enable direct replacements of anisotropic sintered ferrites, however, the isotropic bonded magnets should exhibit certain specific characteristics. For example, the $Nd_2Fe_{14}B$ materials should be capable of being produced in large quantity to meet the economic scale of production for lowering costs. Thus, the materials must be highly quenchable using current melt spinning or jet casting technologies without additional capital investments to enable high throughput production. Also, the magnetic properties, e.g., the $B_r$, $H_{ci}$, and $(BH)_{max}$ values, of the $Nd_2Fe_{14}B$ materials should be readily adjustable to meet the versatile application demands. Therefore, the alloy composition should allow adjustable elements to independently control the $B_r$, $H_{ci}$, and/or quenchability. In addition, the isotropic $Nd_2Fe_{14}B$-type bonded magnets should exhibit comparable thermal stability when compared to that of anisotropic sintered ferrite over similar operating temperature ranges. For example, the isotropic bonded magnets should exhibit comparable $B_r$ and $H_{ci}$ characteristics compared to that of anisotropic sintered ferrites at 80 to 100° C. and low flux aging losses.

Conventional $Nd_2Fe_{14}B$ type melt spun isotropic powders exhibit typical $B_r$ and $H_{ci}$ values of around 8.5–8.9 kG and 9 to 11 kOe, respectively, which make this type of powders usually suitable for anisotropic sintered ferrite replacements. The higher $B_r$ values could saturate the magnetic circuit and choke the devices, thus preventing the realization of the benefit of the high values. To solve this problem, bonded magnet manufacturers have usually used a non-magnetic powder, such as Cu or Al, to dilute the concentration of magnetic powder and to bring the $B_r$ values to the desired levels. However, this represents an additional step in magnet manufacturing process and thus adds costs to the finished magnets.

The high $H_{ci}$ values, especially those higher than 10 kOe, of conventional $Nd_2Fe_{14}B$ type bonded magnets also present a common problem for magnetization. As most anisotropic sintered ferrites exhibit $H_{ci}$ values of less than 4.5 kOe, a magnetizing field with peak magnitude of 8 kOe is sufficient to fully magnetize the magnets in devices. However, this magnetizing field is insufficient to fully magnetize certain conventional $Nd_2Fe_{14}B$ type isotropic bonded magnets to reasonable levels. Without being fully magnetized, the advantages of higher $B_r$ or $H_{ci}$ values of conventional isotropic $Nd_2Fe_{14}B$ bonded magnet can not be fully realized. To overcome the magnetizing issues, bonded magnet manufacturers have used powders having low $H_{ci}$ values to enable a full magnetization using the magnetizing circuit currently available at their facilities. This approach, however, does not take full advantage of the high $H_{ci}$ value potential.

Many improvements of melt spinning technology have also been documented to control the microstructure of $Nd_2Fe_{14}B$-type materials in an attempt to obtain materials of higher magnetic performance. However, many of the attempted efforts have dealt only with general processing improvements without focusing on specific materials and/or applications. For example, U.S. Pat. No. 5,022,939 to Yajima et al. claims that use of refractory metals provides a permanent magnet material exhibiting high coercive force, high energy product, improved magnetization, high corrosion resistance, and stable performance. The patent claims that the addition of the M element controls the grain growth and maintains the coercive force through high temperatures for a long time. Refractory metal additions, however, often form refractory metal-borides and may decrease the $B_r$ value of the magnetic materials obtained, unless average grain size and refractory metal-borides can be carefully controlled and uniformly dispersed throughout the materials to enable exchange coupling to occur. Further, the inclusion of refractory metals in alloy composition, as disclosed in the Yajima patent may actually narrow the optimal wheel speed window for achieving high performance powders.

U.S. Pat. No. 4,765,848 to Mohri et al. claims that the incorporation of La and/or Ce in rare earth based melt spun materials reduces material cost. However, the alleged reduction in cost is achieved by sacrificing magnetic performance. Moreover, this patent does not disclose ways in which the quenchability of melt spun precursors may be improved. U.S. Pat. Nos. 4,402,770 and 4,409,043 to Koon disclose the use of La for producing melt spun R—Fe—B precursors. However, these patents do not disclose how to use La to control the magnetic properties, namely the $B_r$ and $H_{ci}$ values, to desired levels.

U.S. Pat. No. 6,478,891 to Arai claims that the use of 0.02 to 1.5 at % of Al in an alloy with nominal composition of $R_x(Fe_{1-y}Co_y)_{100-x-z-w}B_zAl_w$, where $7.1 \leqq x \leqq 9.0$, $0 \leqq y \leqq 0.3$, $4.6 \leqq z \leqq 6.8$ and $0.02 \leqq w \leqq 1.5$, improves the performance of materials composed of hard and soft magnetic phases. The patent, however, does not disclose the various impact of Al addition, e.g., on the phase structure and on the wetting behavior during melt spinning or jet casting processes.

Arai et al., *IEEE Trans. on Magn.*, 38:2964–2966 (2002), reports that a grooved wheel with ceramic coating can improve the magnetic properties of melt spun materials. This claimed improvement, however, involves a modification of current jet casting equipment and process, and therefore is unsuitable for using existing manufacture facilities. Moreover, the approach only addresses melt spinning processes using relatively high wheel speeds. In a production situation, however, high wheel speed is usually undesirable because it makes the process more difficult to control and increases machine wear.

Therefore, there is still a need for isotropic Nd—Fe—B type magnetic materials with relatively high $B_r$ and $H_{ci}$ values and exhibiting good corrosion resistance and thermal stability. There is also a need for such materials to have good quenchability, e.g., during rapid solidification processes, such that they are suitable for replacement of anisotropic sintered ferrites in many applications.

SUMMARY OF THE INVENTION

The present invention provides RE-TM-B-type magnetic materials made by rapid solidification process and bonded magnets produced from the magnetic materials. The magnetic materials of this invention exhibit relatively high $B_r$ and $H_{ci}$ values and good corrosion resistance and thermal stability. The materials also have good quenchability, e.g., during rapid solidification processes. These qualities of the materials make them suitable for replacement of anisotropic sintered ferrites in many applications.

In a first aspect, the present invention encompasses a magnetic material that has been prepared by a rapid solidification process, followed by a thermal annealing process, preferably at a temperature range of about 300° C. to about 800° C. for about 0.5 minutes to about 120 minutes. The magnetic material has the composition, in atomic percentage, of $(R_{1-a}R'_a)_uFe_{100-u-v-w-x-y}Co_vM_wT_xB_y$, wherein R is Nd, Pr, Didymium (a nature mixture of Nd and Pr at a composition of about $Nd_{0.75}Pr_{0.25}$, also referred to in this application by the symbol "MM"), or a combination thereof; R' is La, Ce, Y, or a combination thereof; M is one or more of Zr, Nb, Ti, Cr, V, Mo, W, and Hf; and T is one or more of Al, Mn, Cu, and Si. Further, the values for a, u, v, w, x, and y are as follows: $0.01 \leqq a \leqq 0.8$, $7 \leqq u \leqq 13$, $0 \leqq v \leqq 20$, $0.01 \leqq w \leqq 1$, $0.1 \leqq x \leqq 5$, and $4 \leqq y \leqq 12$. In addition, the magnetic material exhibits a remanence ($B_r$) value of from about 6.5 kG to about 8.5 kG and an intrinsic coercivity ($H_{ci}$) value of from about 6.0 kOe to about 9.9 kOe.

In a specific embodiment, the rapid solidification process used for the preparation of the magnetic material of the present invention is a melt-spinning or jet-casting process at a nominal wheel speed of from about 10 meter/second to about 60 meter/second. More specifically, the nominal wheel speed is from about 15 meter/second to about 50 meter/second. In another specific embodiment, the wheel speed is from about 35 meter/second to about 45 meter/second. Preferably, the actual wheel speed is within plus or minus 0.5%, 1.0%, 5.0%, 10%, 15%, 20%, 25% or 30% of the nominal wheel speed and that the nominal wheel speed is an optimum wheel speed of producing the magnetic material by the rapid solidification process, followed by the thermal annealing process. In yet another embodiment, the thermal annealing process used for the preparation of the magnetic material of the present invention is at a temperature range of about 600° C. to about 700° C. for about 2 to about 10 minutes.

In specific embodiments of the present invention, M is selected from Zr, Nb, or a combination thereof and T is selected from Al, Mn, or a combination thereof. More specifically, M is Zr and T is Al.

The present invention also encompasses magnetic materials wherein the values for a, u, v, w, x, and y are independent of each other and fall within the following ranges: $0.2 \leqq a \leqq 0.6$, $10 \leqq u \leqq 13$, $0 \leqq v \leqq 10$, $0.1 \leqq w \leqq 0.8$, $2 \leqq x \leqq 5$, and $4 \leqq y \leqq 10$. Other specific ranges include: $0.25 \leqq a \leqq 0.5$, $11 \leqq u \leqq 12$, $0 \leqq v \leqq 5$, $0.2 \leqq w \leqq 0.7$, $2.5 \leqq x \leqq 4.5$, and $5 \leqq y \leqq 6.5$; and $0.3 \leqq a \leqq 0.45$, $11.3 \leqq u \leqq 11.7$, $0 \leqq v \leqq 2.5$, $0.3 \leqq w \leqq 0 \leqq x \leqq 4$, and $5.7 \leqq y \leqq 6.1$. In another specific embodiment, the values of a and x are as follows: $0.01 \leqq a \leqq 0.1$ and $0.1 \leqq x \leqq 1$.

In another embodiment of the present invention, the magnetic material exhibits a $B_r$ value of from about 7.0 kG to about 8.5 kG and $H_{ci}$ value of from about 6.5 kOe to about 9.9 kOe. Specifically, the magnetic material exhibits a $B_r$ value of from about 7.2 kG to about 7.8 kG and, independently, an $H_{ci}$ value of from about 6.7 kOe to about 7.3 kOe. Alternatively, the magnetic material exhibits a $B_r$ value of from about 7.8 kG to about 8.3 kG and, independently, an $H_{ci}$ value of from about 8.5 kOe to about 9.5 kOe.

Other specific embodiments of the present invention include that the material exhibits a near stoichiometric $Nd_2Fe_{14}B$ type single-phase microstructure, as determined by X-Ray diffraction; that the material has crystal grain sizes ranging from about 1 nm to about 80 nm or, specifically, from about 10 nm to about 40 nm.

In a second aspect, the present invention encompasses a bonded magnet comprising a magnetic material and a bonding agent. The magnetic material has been prepared by a rapid solidification process, followed by a thermal annealing process, preferably at a temperature range of about 300° C. to about 800° C. for about 0.5 minutes to about 120 minutes. Further, the magnetic material has the composition, in atomic percentage, of $(R_{1-a}R'_a)_uFe_{100-u-v-w-x-y}Co_vM_wT_xB_y$, wherein R is Nd, Pr, Didymium (a nature mixture of Nd and Pr at composition of $Nd_{0.78}Pr_{0.25}$), or a combination thereof; R' is La, Ce, Y, or a combination thereof; M is one or more of Zr, Nb, Ti, Cr, V, Mo, W, and Hf; and T is one or more of Al, Mn, Cu, and Si. Further, the values for a, u, v, w, x, and y are as follows: $0.01 \leqq a \leqq 0.8$, $7 \leqq u \leqq 13$, $0 \leqq v \leqq 20$, $0.01 \leqq w \leqq 1$, $0.1 \leqq x \leqq 5$, and $4 \leqq y \leqq 12$. In addition, the magnetic material exhibits a remanence ($B_r$) value of from about 6.5 kG to about 8.5 kG and an intrinsic coercivity ($H_{ci}$) value of from about 6.0 kOe to about 9.9 kOe.

In one specific embodiment, the bonding agent is epoxy, polyamide (nylon), polyphenylene sulfide (PPS), a liquid crystalline polymer (LCP), or combinations thereof. In another specific embodiment, the bonding agent further comprises one or more additives selected from a high molecular weight multi-functional fatty acid ester, stearic acid, hydroxy stearic acid, a high molecular weight complex ester, a long chain ester of pentaerythritol, palmilic acid, a polyethylene based lubricant concentrate, an ester of montanic acid, a partly saponified ester of montanic acid, a polyolefin wax, a fatty bis-amide, a fatty acid secondary amide, a polyoctanomer with high trans content, a maleic anhydride, a glycidyl-functional acrylic hardener, zinc stearate, and a polymeric plasticizer.

Other specific embodiments of the present invention include that the bonded magnet comprises, by weight, from about 1% to about 5% epoxy and from about 0.01% to about 0.05% zinc stearate; that the bonded magnet has a permeance coefficient or load line of from about 0.2 to about 10; that the magnet exhibit a flux-aging loss of less than about 6.0% when aged at 100° C. for 100 hours; that the magnet is made by compression molding, injection molding, calendering, extrusion, screen printing, or a combination thereof; and that the magnet is made by compression molding at a temperature ranges of 40° C. to 200° C.

In a third aspect, the present invention encompasses a method of making a magnetic material. The method comprises forming a melt comprising the composition, in atomic percentage, of $(R_{1-a}R'_a)_uFe_{100-u-v-w-x-y}Co_vM_wT_xB_y$; rapidly solidifying the melt to obtain a magnetic powder; and thermally annealing the magnetic powder at a temperature range of about 350° C. to about 800° C. for about 0.5 minutes to about 120 minutes; wherein R is Nd, Pr, Didymium (a nature mixture of Nd and Pr at composition of $Nd_{0.75}Pr_{0.25}$), or a combination thereof; R' is La, Ce, Y, or a combination thereof; M is one or more of Zr, Nb, Ti, Cr, V, Mo, W, and Hf; and T is one or more of Al, Mn, Cu, and Si. Further, the values for a, u, v, w, x, and y are as follows: $0.01 \leqq a \leqq 0.8$, $7 \leqq u \leqq 13$, $0 \leqq v \leqq 20$, $0.01 \leqq w \leqq 1$, $0.1 \leqq x \leqq 5$, and $4 \leqq y \leqq 12$. In addition, the magnetic material exhibits a remanence ($B_r$) value of from about 6.5 kG to about 8.5 kG and an intrinsic coercivity ($H_{ci}$) value of from about 6.0 kOe to about 9.9 kOe.

In a specific embodiment, the step of rapidly solidifying comprises a melt-spinning or jet-casting process at a nominal wheel speed of from about 10 meter/second to about 60 meter/second. More specifically, the nominal wheel speed is from about 35 meter/second to about 45 meter/second. Preferably, the actual wheel speed is within plus or minus 0.5%, 1.0%, 5.0%, 10%, 15%, 20%, 25% or 30% of the nominal wheel speed and that the nominal wheel speed is an optimum wheel speed of producing the magnetic material by the rapid solidification process, followed by the thermal annealing process.

DETAILED DESCRIPTION OF THE INVENTION

Figure 1:
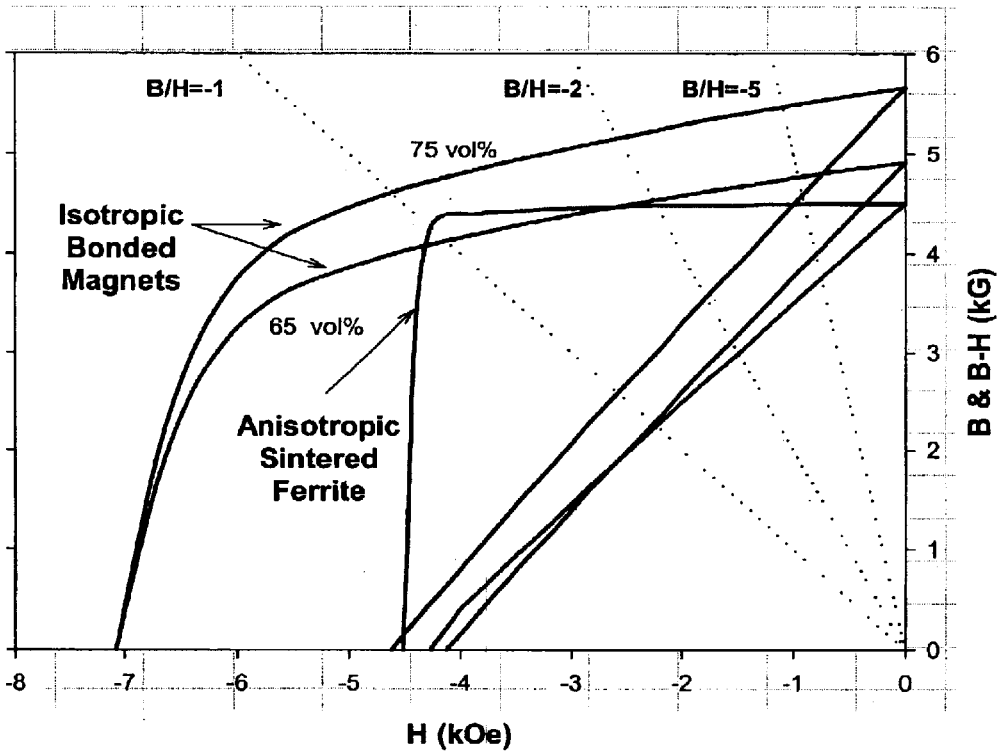
FIG. 1 shows a comparison of the second quadrant demagnetization curves at 20° C. of a commercially available anisotropic sintered ferrite of high $B_r$ and $H_{ci}$ values with that of an isotropic bonded magnet of the present invention, which has values of $B_r$=7.5 kG and $H_{ci}$=7 kOe, with volume fractions of isotropic NdFeB of 65 and 75 vol %.

The present invention encompasses a $R_2Fe_{14}B$-based magnetic material that comprises three distinct types of elements to independently and simultaneously: (i) enhance the quenchability and (ii) adjust the $B_r$ and $H_{ci}$ values of the material. Specifically, the material of this invention comprises alloys with nominal compositions near the stoichiometric $Nd_2Fe_{14}B$ and exhibiting nearly single-phase microstructure. Further, the material contains one or more of Al, Si, Mn, or Cu to help in manipulating the value of $B_r$; La or Ce to help in manipulating the value of $H_{ci}$, and one of more of refractory metals such as Zr, Nb, Ti, Cr, V, Mo, W, and Hf, to improve the quenchability or to reduce the optimum wheel speed required for melt spinning. The combination of Al, La, and Zr may also improve the wetting behavior of liquid metal to wheel surface and broadens the wheel speed window for optimal quenching. If necessary, a dilute Co-addition can also be incorporated to improve the reversible temperature coefficient of $B_r$ (commonly known as $\alpha$). Thus, compared to conventional attempts, the present invention provides a more desirable multi-factor approach and uses a novel alloy composition that allows manipulation of key magnetic properties and a broad wheel speed window for melt spinning without modifying current wheel configurations. Bonded magnets made from the material may be used for replacement of anisotropic sintered ferrites in many applications.

The alloy compositions of this invention are "highly quenchable," which, within the context of this invention, means that the materials can be produced by a rapid solidification process at a relatively low optimal wheel speed with a relatively broad optimal wheel speed window, as compared to the optimal wheel speed and window for producing conventional materials. For example, when using a laboratory jet caster, the optimum wheel speed required to produce the highly quenchable magnetic materials of the present invention is less than 25 meter/second (m/s), preferably less than 20 meter/second, with an optimal quenching speed window of at least ±15%, preferably ±25% of the optimal wheel speed. Under actual production conditions, the optimum wheel speed required to produce the highly quenchable magnetic materials of the present invention is less than 60 meter/second, preferably less than 50 meter/second, with an optimal quenching speed window of at least ±15%, preferably ±30% of the optimal wheel speed.

Within the meaning of the present invention, "optimum wheel speed ($V_{ow}$)," means the wheel speed that produces the optimum $B_r$ and $H_{ci}$ values after thermal annealing. Further, as actual wheel speed in real-world processes inevitably varies within a certain range, magnetic materials are always produced within a speed window, rather than a single speed. Thus, within the meaning of the present invention, "optimal quenching speed window" is defined as wheel speeds that are close and around the optimum wheel speed and that produce magnetic materials with identical or almost identical $B_r$ and $H_{ci}$ values as that produced using the optimum wheel speed. Specifically, the magnetic material of the present invention can be produced at an actual wheel speed within plus or minus 0.5%, 1.0%, 5.0%, 10%, 15%, 20%, 25% or 30% of the nominal optimal wheel speed.

As discovered by the present invention, the optimum wheel speed ($V_{ow}$) may vary according to factors such as the orifice size of the jet casting nozzle, the liquid (molten alloy) pouring rate to the wheel surface, diameter of the jet casting wheel, and wheel material. Thus, the optimum wheel speed for producing the highly quenchable magnetic materials of the present invention may vary from about 15 to about 25 meter/second when using a laboratory jet-caster and from about 25 to about 60 meter/second under actual production conditions. The unique characters of the present invention's materials enable the materials to be produced with these various optimal wheel speed within a wheel speed window of plus or minus 0.5%, 1.0%, 5.0%, 10%, 15%, 20% 25% or 30% of the optimum wheel speed. This combination of flexible optimal wheel speed and broad speed window enables the production of the highly quenchable magnetic materials of the present invention. Moreover, this highly quenchable characteristic of the materials enables one to increase the productivity by making it possible for one to use multiple nozzles for jet casting. Alternatively, one may also increase the liquid pouring rate, e.g., by enlarging the orifice size of the jet casting nozzle, to the wheel surface if a higher wheel speed is desirable for high productivity.

Typical room temperature magnetic properties of the present invention's materials include a value of $B_r$ at about 7.5±0.5 kG and a value of $H_{ci}$ at about 7.0±0.5 kOe. Alternatively, the magnetic materials exhibit a $B_r$ value of about 8.0±0.5 kG and an $H_{ci}$ value of about 9.0±0.5 kOe. Although the material of the present invention often exhibits a single-phase microstructure, the materials may also contain the $R_2Fe_{14}B/\alpha$-Fe or $R_2Fe_{14}B/Fe_3B$ type nanocomposites and still retain most of its distinct properties. Other properties of the magnetic powders and bonded magnets of the present invention include that the material has very fine grain size, e.g., from about 10 nm to about 40 nm; that the typical flux aging loss of the bonded magnets made from powders, e.g., epoxy bonded magnets with PC (permeance coefficient or load line) of 2, are less than 5% when aged at 100° C. for 100 hours.

Thus, in one aspect, the present invention provides a magnetic material that has a specific composition and is prepared by a rapid solidification process, which is followed by a thermal annealing process, preferably at a temperature range of about 300° C. to about 800° C. for about 0.5 minutes to about 120 minutes. In addition, the magnetic material exhibits a remanence ($B_r$) value of from about 6.5 kG to about 8.5 kG and an intrinsic coercivity ($H_{ci}$) value of from about 6.0 kOe to about 9.9 kOe.

The specific composition of the magnetic material can be defined as, in atomic percentage, $(R_{1-a}R'_a)_uFe_{100-u-v-w-x-y}CO_vM_wT_xB_y$, wherein R is Nd, Pr, Didymium (a nature mixture of Nd and Pr at a composition of about $Nd_{0.75}Pr_{0.25}$, also represented in the present invention by the symbol "MM"), or a combination thereof; R' is La, Ce, Y, or a combination thereof; M is one or more of Zr, Nb, Ti, Cr, V, Mo, W, and Hf; and T is one or more of Al, Mn, Cu, and Si. Further, the values for a, u, v, w, x, and y are as follows: $0.01 \leqq a \leqq 0.8$, $7 \leqq u \leqq 13$, $0 \leqq v \leqq 20$, $0.01 \leqq w \leqq 1$, $0.1 \leqq x \leqq 5$, and $4 \leqq y \leqq 12$.

In specific embodiments of the present invention, M is selected from Zr, Nb, or a combination thereof and T is selected from Al, Mn, or a combination thereof. More specifically, M is Zr and T is Al.

The present invention also encompasses specific magnetic materials wherein the values for a, u, v, w, x, and y are independent of each other and fall within the following ranges: $0.2 \leqq a \leqq 0.6$, $10 \leqq u \leqq 13$, $0 \leqq v \leqq 10$, $0.1 \leqq w \leqq 0.8$, $2x \leqq 5$, and $4 \leqq y \leqq 10$. Other specific ranges include: $0.25 \leqq a \leqq 0.5$, $11 \leqq u \leqq 12$, $0 \leqq v \leqq 5$, $0.2 \leqq w \leqq 0.7$, $2.5 \leqq x \leqq 4.5$, and $5 \leqq y \leqq 6.5$; and $0.3 \leqq a \leqq 0.45$, $11.3 \leqq u \leqq 11.7$, $0 \leqq v \leqq 2.5$, $0,3 \leqq w \leqq 0.6$, $3 \leqq x \leqq 4$, and $5.7 \leqq y \leqq 6.1$. In another specific embodiment, the values of a and x are as follows: $0.01 \leqq a \leqq 0.1$ and $0.1 \leqq x \leqq 1$.

Magnetic materials of the present invention can be made from molten alloys of the desired composition which are rapidly solidified into powders/flakes by a melt-spinning or jet-casting process. In a melt-spinning or jet-casting process, a molten alloy mixture is flowed onto the surface of a rapidly spinning wheel. Upon contacting the wheel surface, the molten alloy mixture forms ribbons, which solidify into flake or platelet particles. The flakes obtained through melt-spinning are relatively brittle and have a very fine crystalline microstructure. The flakes can also be further crushed or comminuted before being used to produce magnets.

The rapid solidification suitable for the present invention includes a melt-spinning or jet-casting process at a nominal wheel speed of from about 10 meter/second to about 25 meter/second, or more specifically from about 15 meter/second to about 22 meter/second, when using a laboratory jet-caster. Under actual production conditions, the highly quenchable magnetic materials of the present invention cab be produced at a nominal wheel speed of from about 10 meter/second to about 60 meter/second, or more specifically from about 15 meter/second to about 50 meter/second, and from about 35 meter/second to about 45 meter/second. Because a lower optimum wheel speed usually means that the process can be better controlled, the decrease in $V_{ow}$ in producing the magnetic powders of the present invention represents an advantage in melt spinning or jet casting as it in indicates that a lower wheel speed can be used to produce powder of the same quality.

The present invention also provides that the magnetic material can be produced at a broad optimal wheel speed window. Specifically, the actual wheel speed used in the rapid solidification process is within plus or minus 0.5%, 1.0%, 5.0%, 10%, 15%, 20%, 25% or 30% of the nominal wheel speed of the nominal wheel speed and, preferably, the nominal wheel speed is an optimum wheel speed of producing the magnetic material by the rapid solidification process, followed by the thermal annealing process.

Therefore, the highly quenchable characters of the present invention's materials may also enable higher productivity by permitting increased the alloy pour rate to the wheel surface, such as through enlarging the orifice size of jet casting nozzle, using multiple nozzle, and/or using higher wheel speeds According to the present invention, magnetic materials, usually powders, obtained by the melt-spinning or jet-casting process are heat-treated to improve their magnetic properties. Any commonly employed heat treatment method can be used, although the heat treating step preferably comprises annealing the powders at a temperature between 300° C. to 800° C. for 2 to 120 minutes, or preferably between 600° C. to 700° C., for about 2 to about 10 minutes to obtain the desired magnetic properties.

In another specific embodiment of the present invention, the magnetic material exhibits a $B_r$ value of from about 7.0 kG to about 8.0 kG and $H_{ci}$ value of from about 6.5 kOe to about 9.9 kOe. More specifically, the magnetic material exhibits a $B_r$ value of from about 7.2 kG to about 7.8 kG and an $H_{ci}$ value of from about 6.7 kOe to about 7.3 kOe. Alternatively, the magnetic material exhibits a $B_r$ value of from about 7.8 kG to about 8.3 kG and an $H_{ci}$ value of from about 8.5 kOe to about 9.5 kOe.

Other specific embodiments of the present invention include that the material exhibits a near stoichiometric $Nd_2Fe_{14}B$ type single-phase microstructure, as determined by X-Ray diffraction; that the material has crystal grain sizes ranging from about 1 nm to about 80 nm or, specifically, from about 10 nm to about 40 nm.

FIG. 1 illustrates a comparison, at room temperature or about 20° C., of the second quadrant demagnetization curves of a typical anisotropic sintered ferrite having a $B_r$ of 4.5 kG and $H_{ci}$ of 4.5 kOe with two polymer-bonded magnets made from the isotropic NdFeB based powders of this invention. The isotropic powders used for this illustration exhibits a $B_r$ value of about 7.5 kG, $H_{ci}$ value of about 7 kOe, and $(BH)_{max}$ of 11 MGOe at room temperature. The two bonded magnets contain volume fractions of approximately 65 and 75 vol % magnetic powder, corresponding respectively to the nylon and epoxy-bonded magnets prepared from the isotropic NdFeB powders. The 65 and 75% volume fractions are typical for nylon and epoxy-bonded magnets, respectively, by industry standards and a few percentage variation in volume fraction would be allowable by adjusting the amount of polymer resins used for making bonded magnets.

It can clearly be observed from FIG. 1 that the $B_r$ and $H_{ci}$ values of the two isotropic NdFeB based bonded magnets are higher than that of the anisotropic sintered ferrite magnet. More importantly, the B-curve of the isotropic bonded magnets are higher than that of the anisotropic sintered ferrite where the load lines (dotted lines, the values of which are represented by the absolute value of the B/H ratio) are of more than 1. In practical applications, this means that the isotropic NdFeB bonded magnets can deliver more flux than the anisotropic sintered ferrite magnets for a given magnetic circuit design. In other words, more energy efficient designs can be achieved with the isotropic NdFeB bonded magnets.

Figure 2:
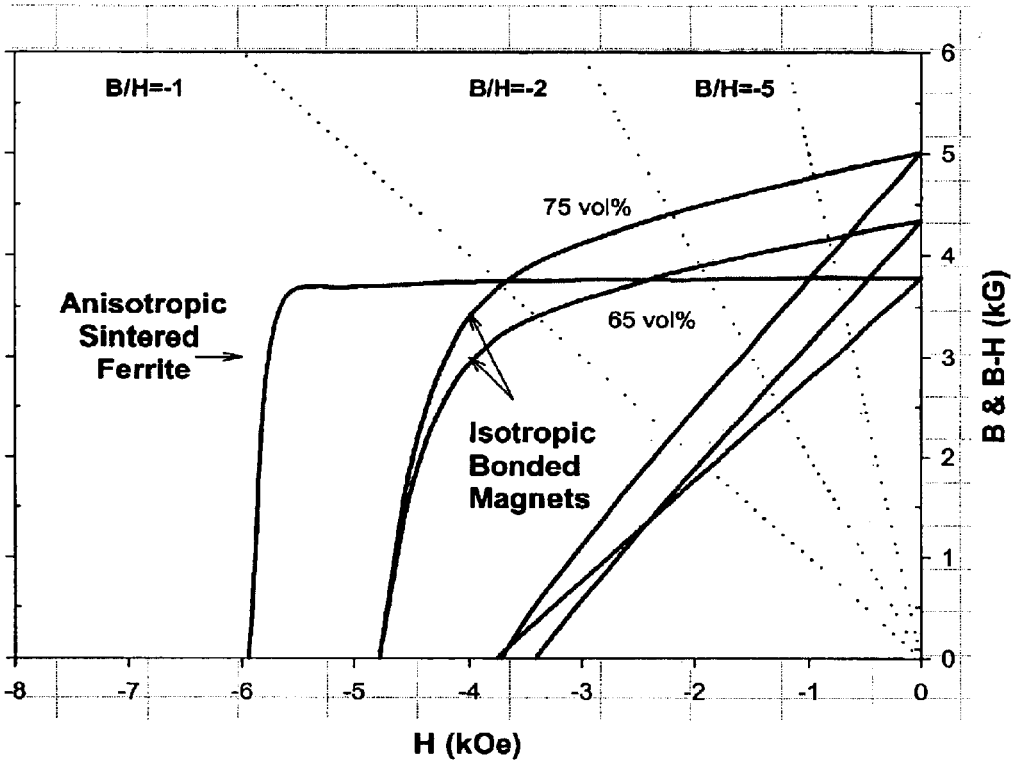
FIG. 2 shows a comparison of the second quadrant demagnetization curves at 100° C. of a commercially available anisotropic sintered ferrite of high $B_r$ and $H_{ci}$ values with that of an isotropic bonded magnet of the present invention, which has values of $B_r$=7.5 kG and $H_{ci}$=7 kOe, when measured at 20° C., with volume fractions of isotropic NdFeB of 65 and 75 vol %.

FIG. 2 illustrates a similar comparison of the second quadrant demagnetization curves of an anisotropic sintered ferrite with the nylon and epoxy-bonded magnets of the same volume fractions shown in FIG. 1, but at 100° C. Despite the fact that anisotropic sintered ferrite shows a positive temperature coefficient of $H_{ci}$, while that of isotropic bonded magnets is negative, it can clearly be seen that the isotropic NdFeB bonded magnets exhibit higher $B_r$ values when compared to that of anisotropic sintered ferrite at 100° C. More importantly, the B-curves of isotropic NdFeB bonded magnets are higher than that of anisotropic sintered ferrite at 100° C. for load lines of greater than 1. Again, this indicates that more energy efficient designs can be achieved at 100° C. if one uses the isotropic NdFeB bonded magnets, as compared to anisotropic sintered ferrite, for a fixed magnetic circuit.

Figure 3:
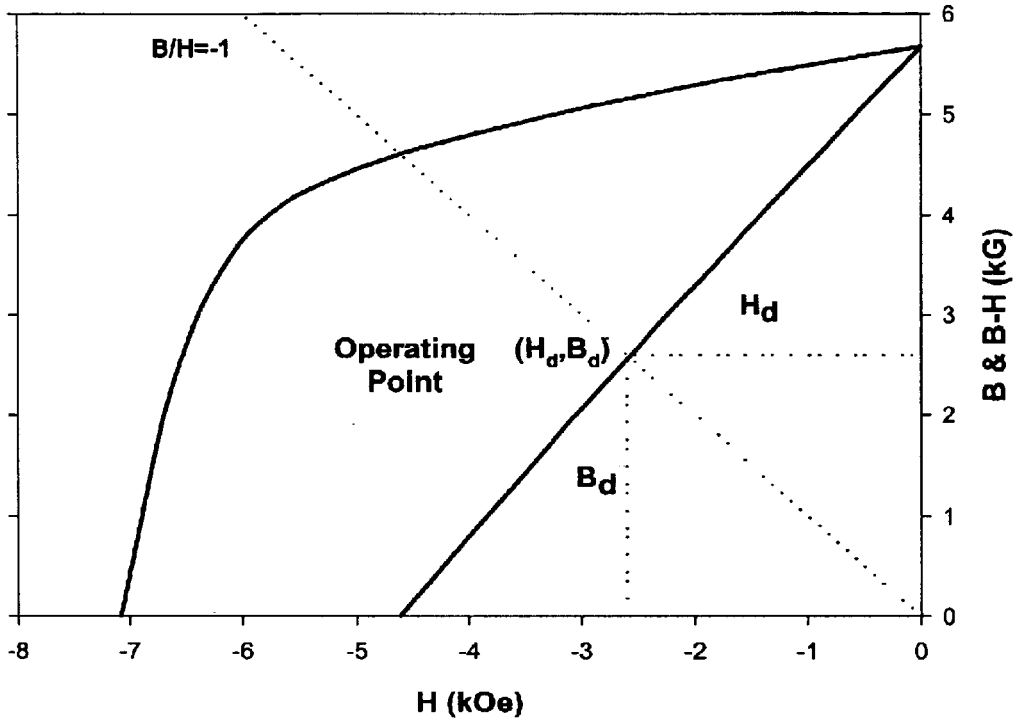
FIG. 3 shows a schematic diagram illustrating the operating point of a bonded magnet of the present invention along a load line of 1.

FIG. 3 shows the second quadrant demagnetization curves of a typical bonded magnet of the present invention operating along a load line of 1, i.e., B/H=−1. The intersection of the B-curve with the load line is the operating point, the coordinates of which can be described with two variables, $H_d$ and $B_d$, and expressed as ($H_d$, $B_d$). When comparing two magnets for a given application, it is important to compare their operating points. Usually, higher magnitudes of $H_d$ and $B_d$ are desired.

Figure 4:
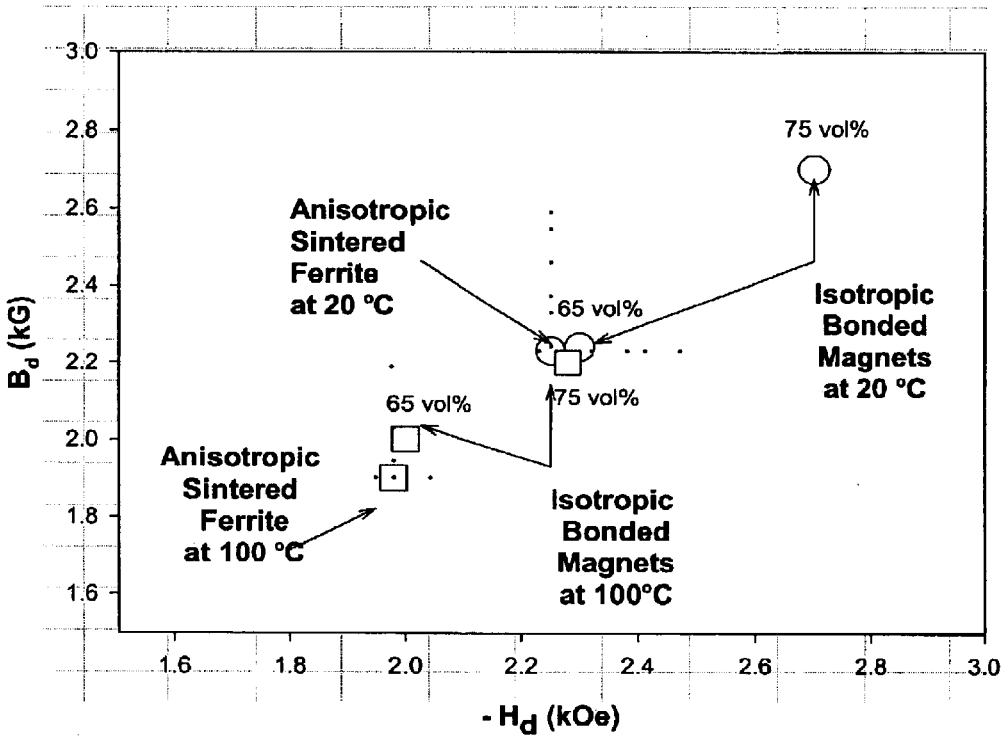
FIG. 4 shows a comparison of operating points at 20° C. and 100° C. of NdFeB type isotropic bonded magnets with volume fractions of 65 and 75 vol % with that of anisotropic sintered ferrites.

FIG. 4 illustrates the operating points along load line of 1 for magnets previously shown in FIGS. 1 and 2. For convenience, the absolute values of $H_d$ are used to construct this graph. As can be seen, the operating point of anisotropic sintered ferrite at 20° C. is at (−2.25 kOe, 2.23 kG). The operating points of Nylon and epoxy-bonded magnets with volume fraction of 65 and 75 vol % at the corresponding temperature are (−2.3 kOe, 2.24 kG) and (−2.7 kOe and (2.7 kG), respectively. Thus, both bonded magnets show higher magnitudes of $H_d$ and $B_d$ values when compared to that of anisotropic sintered ferrite. At 100° C., the operating point of the anisotropic sintered ferrite shifts to (−1.98 kOe, 2.23 kG) and the corresponding nylon and epoxy-bonded magnets are at (−2.0 kOe, 2.0 kG) and (−2.28 kOe, 2.2 kG), respectively. Again, both isotropic bonded magnets exhibit higher magnitudes of $H_d$ and $B_d$ when compared to that of anisotropic sintered ferrite.

Thus, FIG. 4 illustrates that isotropic bonded magnets of these properties can replace anisotropic sintered ferrite without sacrificing the thermal stability or demagnetizing field at 100° C. These trends can be applied to any application with load lines of greater than |B/H|=1. This demonstrates that bonded magnets with volume fraction of 65 vol % to 75 vol % prepared from isotropic NdFeB powder with $B_r$ of 7.5±0.5 kG and $H_{ci}$ 7±0.5 kOe can effectively replace anisotropic sintered ferrite for applications up to 100° C.

Figure 5:
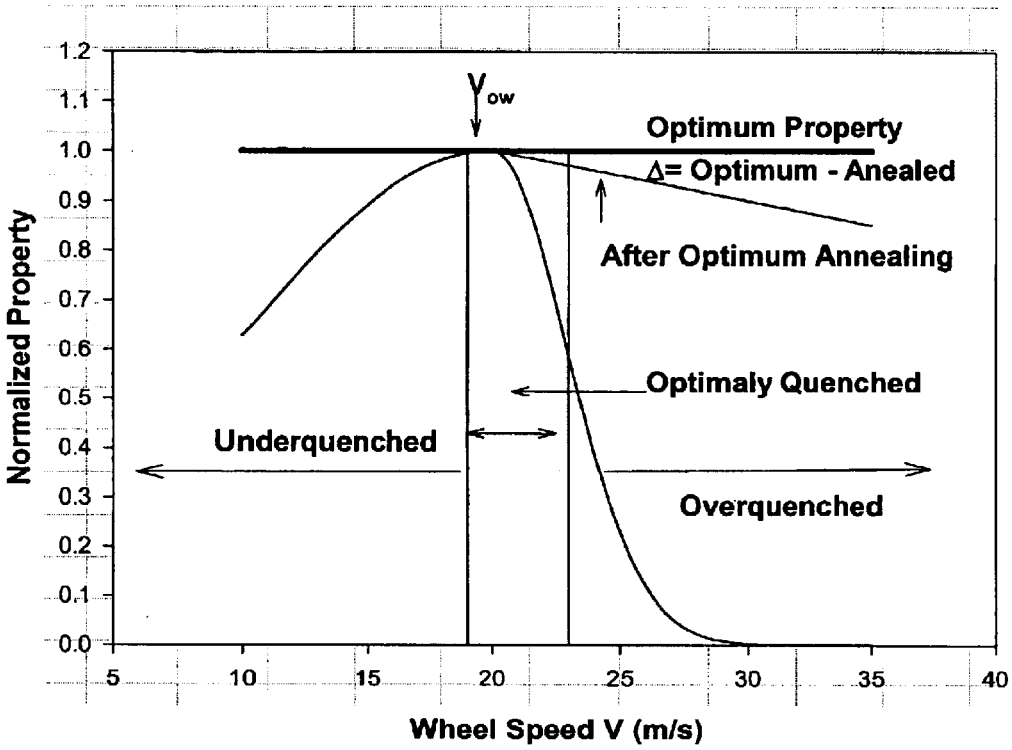
FIG. 5 illustrates a typical melt spinning quenchability curve of $Nd_2Fe_{14}B$-type materials.

FIG. 5 illustrates the relationship between (i) normalized magnetic properties, namely $B_r$, $H_{ci}$, and $(BH)_{max}$, for conventional $R_2Fe_{14}B$ type materials prepared by melt spinning or jet casting and (ii) the wheel speed used to obtain them. Such graphs are referred herein as the quenchability curve for the magnetic materials. As illustrated, at low wheel speeds, the precursor materials are under-quenched and are thus crystallized or partially crystallized with coarse grains. Since grains have already crystallized in the as-spun or as-quenched state, thermal annealing would not improve the magnetic properties regardless of the temperature applied. The $B_r$, $H_{ci}$ or $(BH)_{max}$ values are equal to or less than that in the as-quenched state. In the optimally quenched region, the precursors are fine nanocrystalline. Appropriate thermal annealing afterwards usually leads better defined grains of small and uniform sizes and results in increases in $B_r$, $H_{ci}$ or $(BH)_{max}$ values. At high wheel speeds, the precursors are over-quenched and thus are, most likely, nanocrystalline or partially amorphous in nature. Because the precursor materials are highly over-quenched, there is a large driving force during crystallization which leads to excessive grain growth.

Even with optimum thermal annealing, the magnetic properties developed usually are lower than those of optimally quenched and properly annealed samples. The tilted straight line in FIG. 5 indicates that the properties degrade further if precursor material is further over quenched. As discovered by the present inventors, a lower $V_{ow}$ and broader window around $V_{ow}$ (a wider or flatter curve around $V_{ow}$) lead to the least variations of $B_r$, $H_{ci}$ and $(BH)_{max}$ around $V_{ow}$ in real-world processes, and thus represent the most desirable case for a melt spinning or jet casting process.

Figure 6:
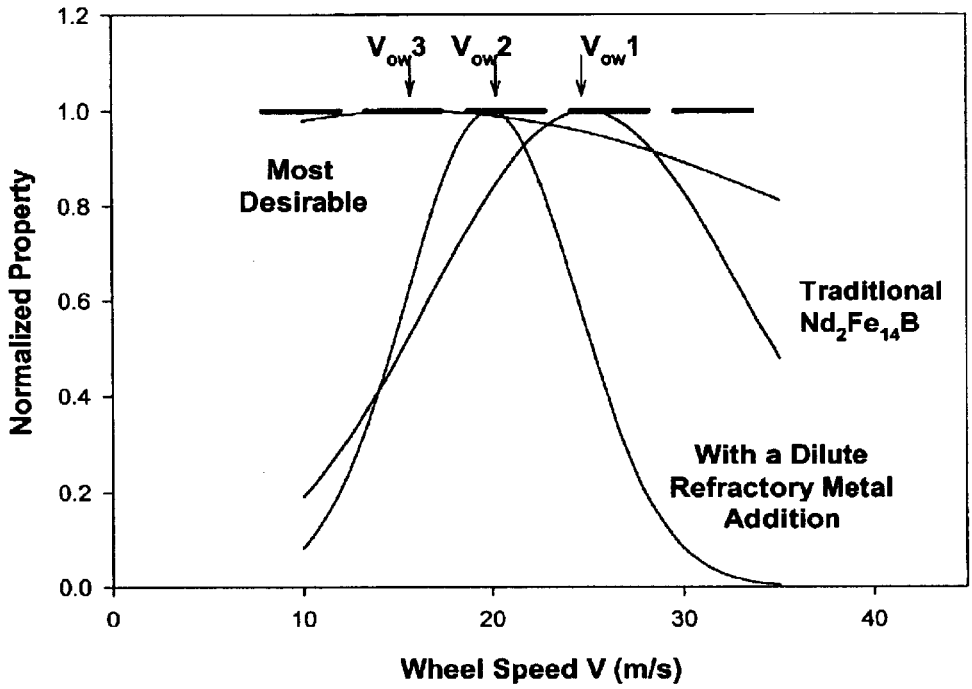
FIG. 6 shows a comparison of the melt spinning quenchability curves of traditional $Nd_2Fe_{14}B$ materials with and without refractory metal addition with a more desirable quenchability curve of the present invention.

FIG. 6 shows a schematic diagram illustrating the impact of refractory metal addition to the quenchability curve of a $R_2Fe_{14}B$-type materials prepared by melt spinning or jet casting. Traditional $R_2Fe_{14}B$ type materials exhibit a broad quenchability curve with high $V_{ow}$ (designated as $V_{ow}1$ in FIG. 6). Refractory metal addition shifts the $V_{ow}$ to a lower wheel speed (designated as $V_{ow}2$). But the quenchability curve becomes very narrow, which means a reduced processing window and increased difficulty for producing optimally quenched precursors and is less desirable for powder production. The most desirable case would be a low $V_{ow}$ (designated as $V_{ow}3$ in FIG. 6) with a broad quenchability curve (a wider or flatter curve around $V_{ow}$).

As illustrated in FIGS. 5 and 6, it is desirable to produce melt spun precursors with a wheel speed near the $V_{ow}$ (optimally quenched state) followed by isothermal annealing to obtain nano-scaled grains with good uniformity. Over-quenched precursors usually can not be annealed to good $B_r$ and $H_{ci}$ values because of the excessive grain growth during crystallization. Under-quenched precursors contain grains of large size and usually do not show good magnetic properties even after annealing. For melt spinning and in powder production, a broad wheel speed window for achieving powder of optimum magnetic $B_r$ and $H_{ci}$ is preferable, as discovered in the present invention.

Figure 7:
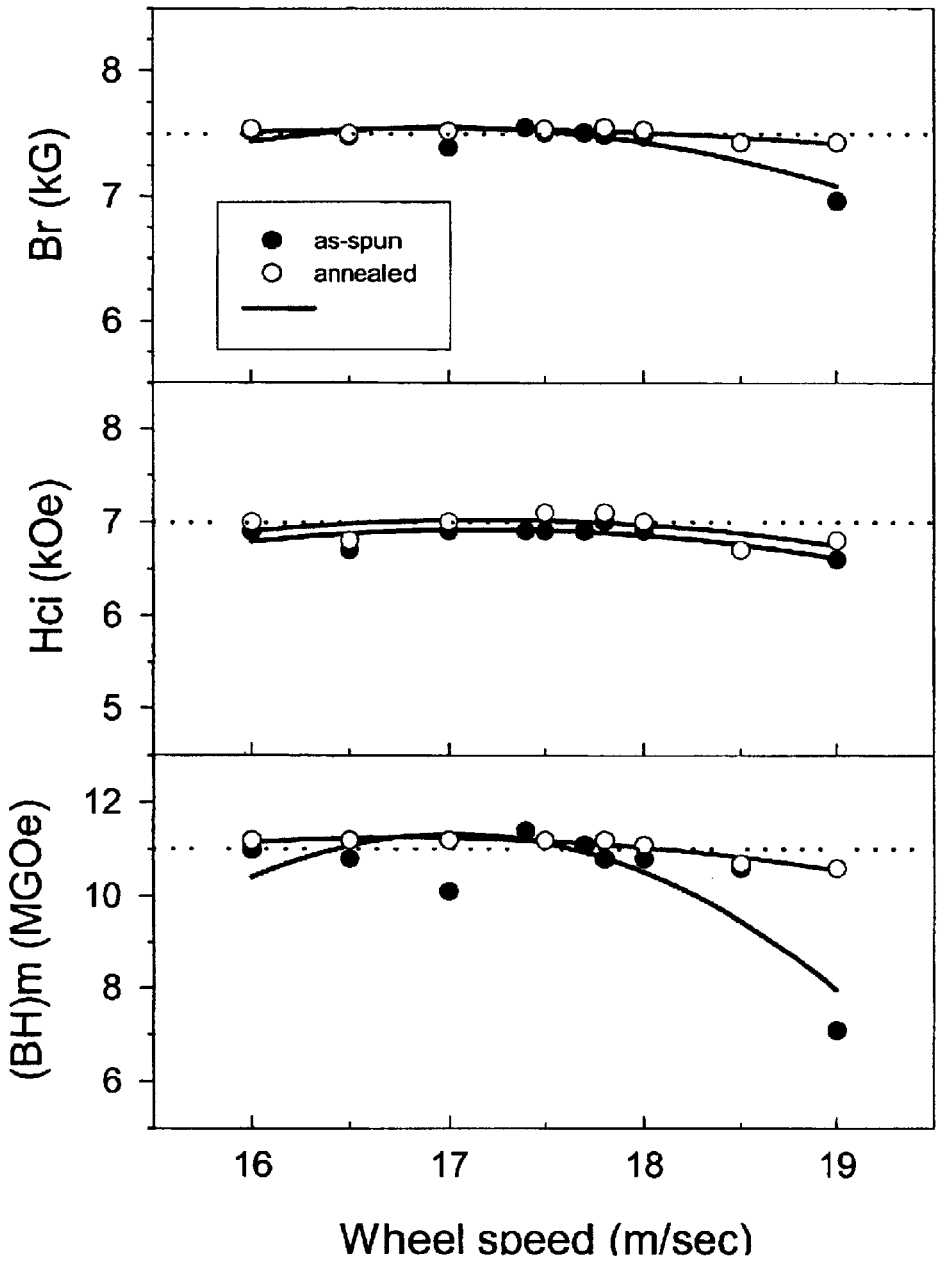
FIG. 7 illustrates the quenchability curves of an alloy of the present invention with nominal composition of $(MM_{0.62}La_{0.38})_{11.5}Fe_{78.9}Zr_{0.5}Al_{3.2}B_{5.9}$.

FIG. 7 illustrates an example of the variation of $B_r$, $H_{ci}$ and $(BH)_{max}$ with the melt spinning wheel speed used for producing powders with nominal composition of $(MM_{0.62}La_{0.38})_{11.5}Fe_{78.9}Zr_{0.5}Al_{3.2}B_{5.9}$, provided by the present invention. A gradual variation of $B_r$, $H_{ci}$, and $(BH)_{max}$ with wheel speed is observed, indicating the composition of this invention can readily be produced by melt spinning or jet casting in a consistent manner.

Figure 8:
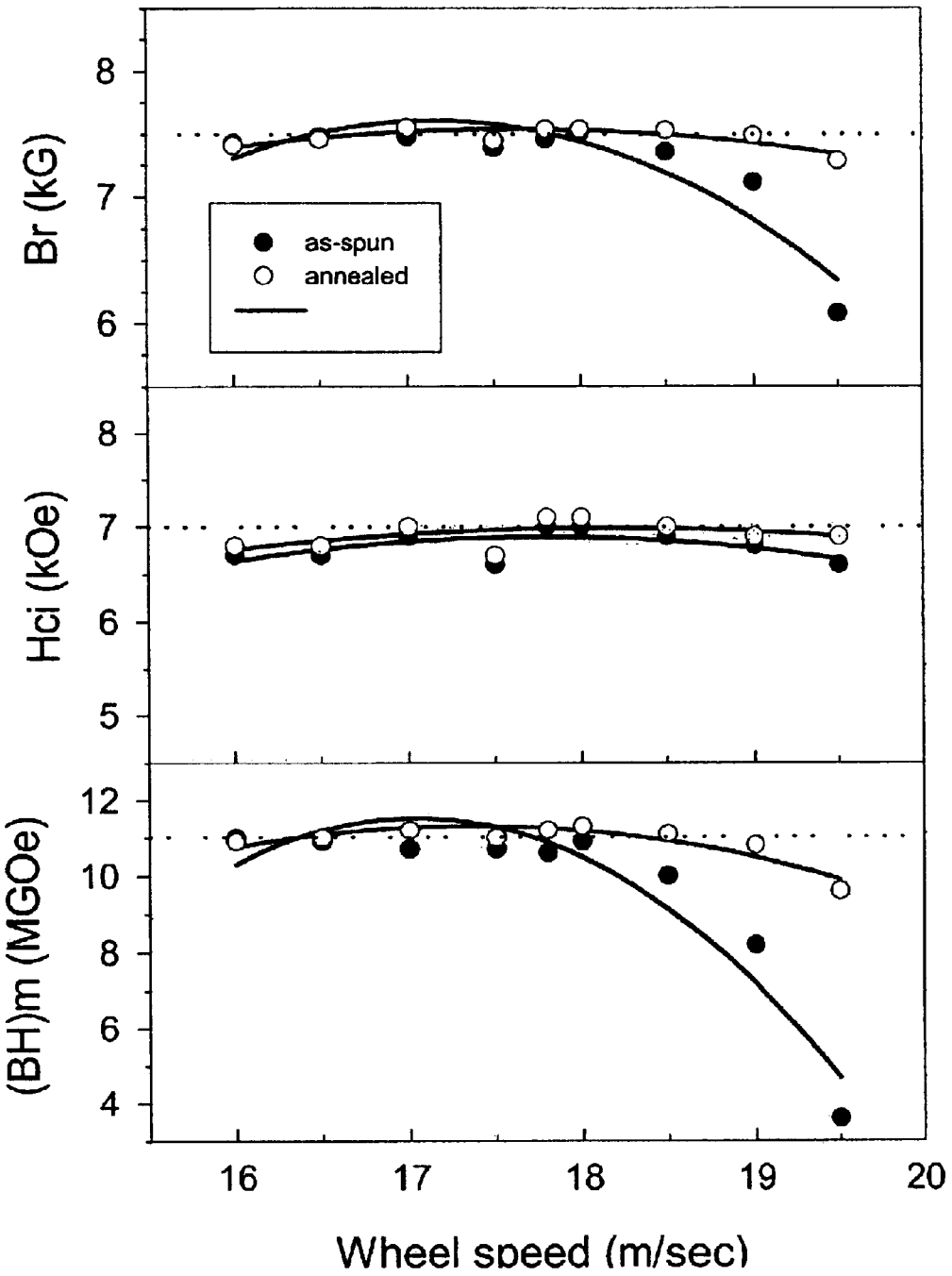
FIG. 8 illustrates the quenchability curves of an alloy of the present invention with nominal composition of $(MM_{0.62}La_{0.38})_{11.5}Fe_{76.1}CO_{2.5}Zr_{0.5}Al_{3.5}B_{5.9}$.

FIG. 8 illustrates an example of the variation of $B_r$, $H_{ci}$, and $(BH)_{max}$ with the melt spinning wheel speed used for producing powders with nominal composition of $(MM_{0.62}La_{0.38})_{11.5}Fe_{76.1}CO_{2.5}Zr_{0.5}Al_{3.5}B_{5.9}$ as provided by the present invention. A gradual variation of $B_r$, $H_{ci}$, and $(BH)_{max}$ with wheel speed is again observed, again indicating the composition of this invention can readily be produced by melt spinning or jet casting in a consistent manner.

Figure 9:
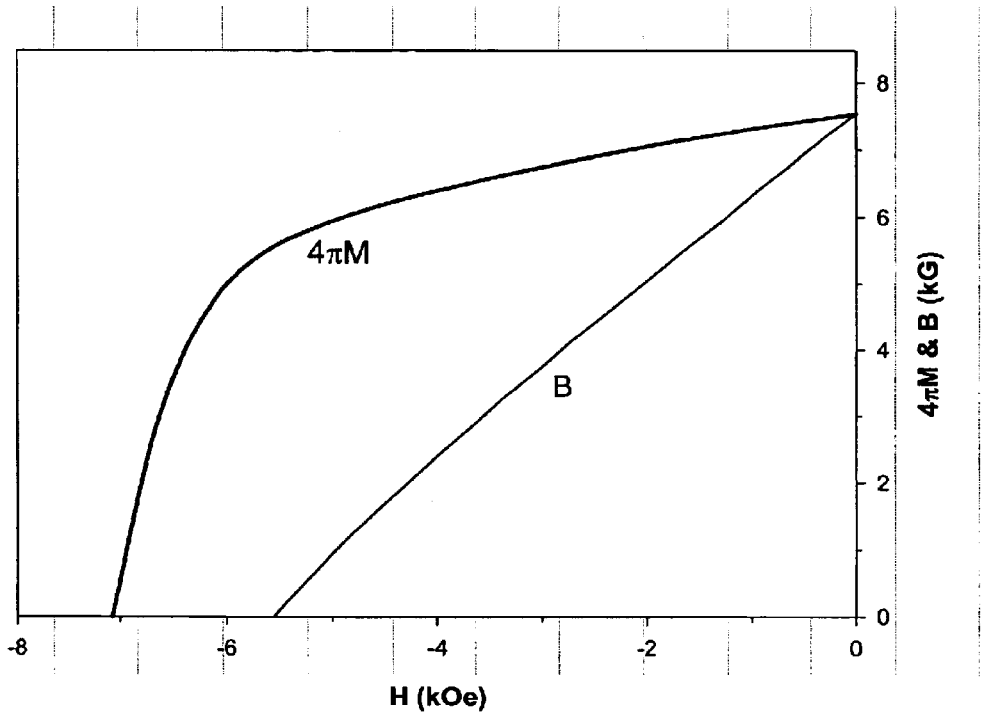
FIG. 9 shows a demagnetization curve of a $(MM_{0.62}La_{0.38})_{11.5}Fe_{78.9}Zr_{0.5}Al_{3.2}B_{5.9}$ powder of the present invention melt-spun at a wheel speed of 17.8 m/s followed by annealing at 640° C. for 2 min.

FIG. 9 illustrates a demagnetization curve of $(MM_{0.62}La_{0.38})_{11.5}Fe_{78.9}Zr_{0.5}Al_{3.2}B_{5.9}$ powder of the present invention melt-spun at a wheel speed of 17.8 m/s followed by annealing at 640° C. for 2 min, as provided by the present invention. The curve is very smooth and square. Powder magnetic properties obtained are $B_r$=7.55 kG, $H_{ci}$= 7.1 kOe, and $(BH)_{max}$=11.2 MGOe.

Figure 10:
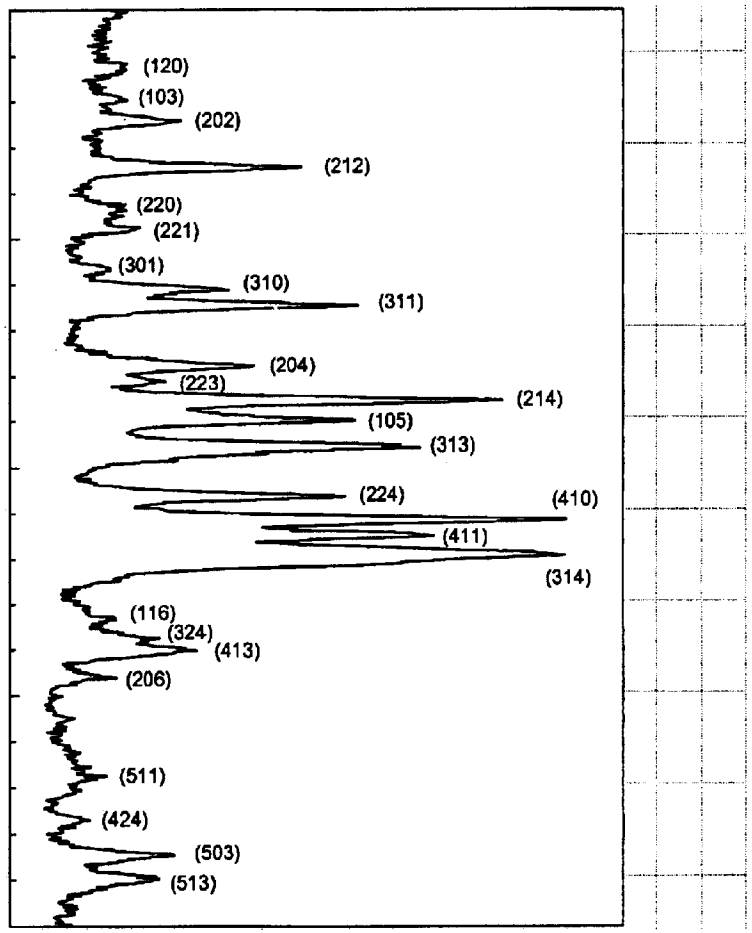
FIG. 10 shows X-ray diffraction (XRD) pattern of a $(MM_{0.62}La_{0.38})_{11.5}Fe_{78.9}Zr_{0.5}Al_{3.2}B_{5.9}$ powder of the present invention melt-spun at a wheel speed of 17.8 m/s followed by annealing at 640° C. for 2 min.

FIG. 10 illustrates an X-ray diffraction (XRD) pattern of $(MM_{0.62}La_{0.38})_{11.5}Fe_{78.9}Zr_{0.5}Al_{3.2}B_{5.9}$ powder melt-spun at a wheel speed of 17.8 m/s followed by annealing at 640° C. for 2 min, as provided by the present invention. All the major peaks are found to belong to the tetragonal structure with the lattice parameters of a=0.8811 nm and c=1.227 nm, confirming that the novel alloys are a 2:14:1 type single-phase material.

Figure 11:
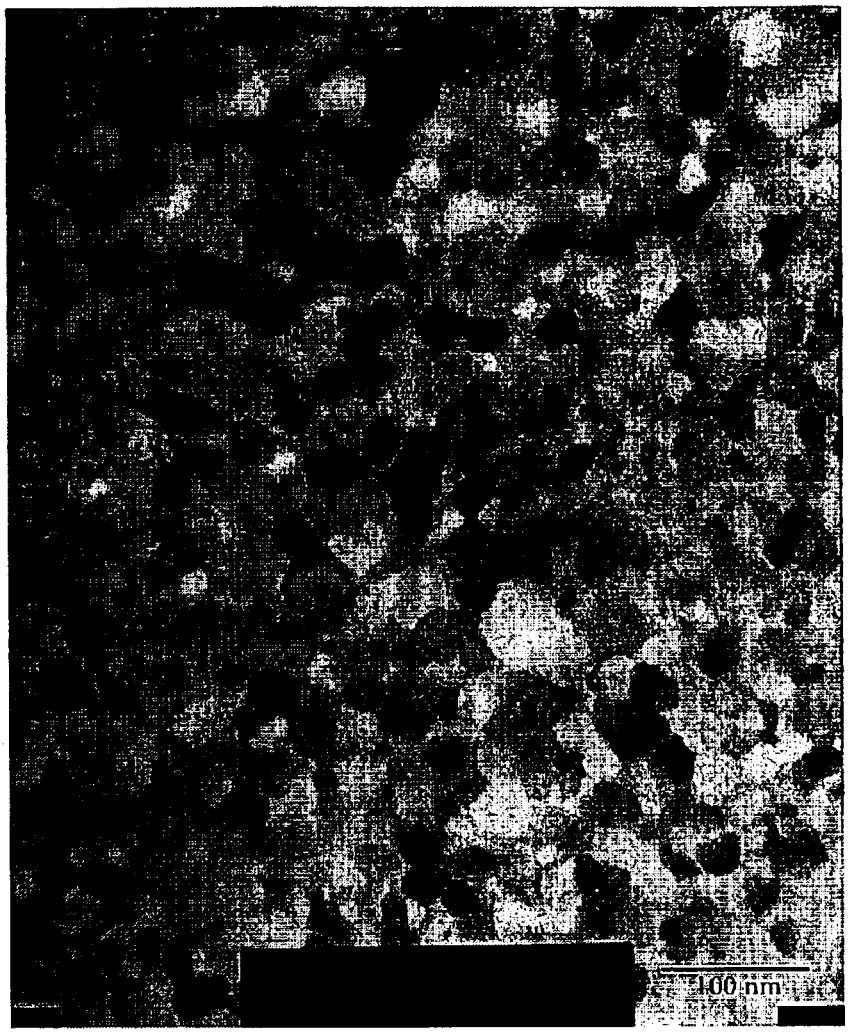
FIG. 11 shows a Transmission Electron Microscopy (TEM) image of a $(MM_{0.62}La_{0.38})_{11.5}Fe_{78.9}Zr_{0.5}Al_{3.2}B_{5.9}$ powder of the present invention melt-spun at a wheel speed of 17.8 m/s followed by annealing at 640° C. for 2 min.
Figure 12:
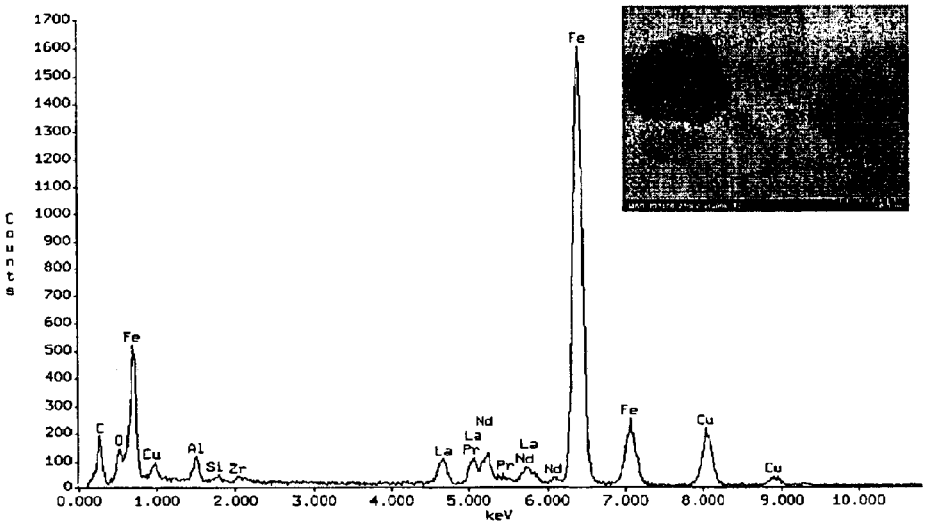
FIG. 12 show the EDAX (Energy Dispersive Analytical X-ray) spectrum of an overview of a $(MM_{0.62}La_{0.38})_{11.5}Fe_{78.9}Zr_{0.5}Al_{3.2}B_{5.9}$ powder of the present invention melt-spun at a wheel speed of 17.8 m/s followed by annealing at 640° C. for 2 min.

FIG. 11 illustrates a Transmission Electron Microscopy (TEM) image of $(MM_{0.62}La_{0.38})_{11.5}Fe_{78.9}Zr_{0.5}Al_{3.2}B_{5.9}$ powder melt-spun at a wheel speed of 17.8 m/s followed by annealing at 640° C. for 2 min, as provided by the present invention. The average grain size is about 20 to 25 nm. The fine and uniform grain size distribution results in a good squareness of the demagnetization curve. For illustration, the EDAX (Energy Dispersive Analytical X-ray) spectrum on an area covering a few grains and grain boundary is shown in FIG. 12. The characteristic peaks of Nd, Pr, La, Al, Zr and B can clearly be detected.

In another aspect, the present invention provides a bonded magnet comprising a magnetic material and a bonding agent. The magnetic material has been prepared by a rapid solidification process, followed by a thermal annealing process at a temperature range of about 300° C. to about 800° C. for about 0.5 minutes to about 120 minutes. Further, the magnetic material has the composition, in atomic percentage, of $(R_{1-a}R'_a)_uFe_{100-u-v-w-x-y}CO_vM_wT_xB_y$, wherein R is Nd, Pr, Didymium (a nature mixture of Nd and Pr at composition of $Nd_{0.75}Pr_{0.25}$), or a combination thereof; R' is La, Ce, Y, or a combination thereof; M is one or more of Zr, Nb, Ti, Cr, V, Mo, W, and Hf; and T is one or more of Al, Mn, Cu, and Si. Further, the values for a, u, v, w, x, and y are as follows: $0.01 \leqq a \leqq 0.8$, $7 \leqq u \leqq 13$, $0 \leqq v \leqq 20$, $0.01 \leqq w \leqq 1$, $0.1 \leqq x \leqq 5$, and $4 \leqq y \leqq 12$. In addition, the magnetic material exhibits a remanence ($B_r$) value of from about 6.5 kG to about 8.5 kG and an intrinsic coercivity ($H_{ci}$) value of from about 6.0 kOe to about 9.9 kOe.

In one specific embodiment, the bonding agent is one or more of epoxy, polyamide (nylon), polyphenylene sulfide (PPS), and a liquid crystalline polymer (LCP). In another specific embodiment, the bonding agent further comprises one or more additives selected from a high molecular weight multi-functional fatty acid ester, stearic acid, hydroxy stearic acid, a high molecular weight complex ester, a long chain ester of pentaerythritol, palmitic acid, a polyethylene based lubricant concentrate, an ester of montanic acid, a partly saponified ester of montanic acid, a polyolefin wax, a fatty bis-amide, a fatty acid secondary amide, a polyoctanomer with high trans content, a maleic anhydride, a glycidyl-functional acrylic hardener, zinc stearate, and a polymeric plasticizer.

The bonded magnet of the present invention can be produced from the magnetic material through a variety of pressing/molding processes, including, but not limited to, compression molding, extrusion, injection molding, calendering, screen printing, spin casting, and slurry coating. In a specific embodiment, the bonded magnet of the present invention is made, after the magnetic powders have been heat treated and mixed with the binding agent, by compression molding.

Other specific embodiments of the present invention include a bonded magnet that comprises, by weight, from about 1% to about 5% epoxy and from about 0.01% to about 0.05% zinc stearate; a bonded magnet that has a permeance coefficient or load line of from about 0.2 to about 10; a bonded magnet that exhibits a flux-aging loss of less than about 6.0% when aged at 100° C. for 100 hours; a bonded magnet that is made by compression molding, injection molding, calendering, extrusion, screen printing, or a combination thereof; and a bonded magnet made by compression molding at a temperature ranges of 40° C. to 200° C.

In a third aspect, the present invention encompasses a method of making a magnetic material. The method comprises forming a melt comprising the composition, in atomic percentage, of $(R_{1-a}R'_a)_uFe_{100-u-v-w-x-y}CO_vM_wT_xB_y$; rapidly solidifying the melt to obtain a magnetic powder; and thermally annealing the magnetic powder at a temperature range of about 350° C. to about 800° C. for about 0.5 minutes to about 120 minutes. With regard to the composition, R is Nd, Pr, Didymium (a nature mixture of Nd and Pr at composition of $Nd_{0.75}Pr_{0.25}$), or a combination thereof; R' is La, Ce, Y, or a combination thereof; M is one or more of Zr, Nb, Ti, Cr, V, Mo, W, and Hf; and T is one or more of Al, Mn, Cu, and Si. Further, the values for a, u, v, w, x, and y are as follows: $0.01 \leqq a \leqq 0.8$, $7 \leqq u \leqq 13$, $0 \leqq v \leqq 20$, $0.01 \leqq w \leqq 1$, $0. \leqq x \leqq 5$, and $4 \leqq y \leqq 12$. In addition, the magnetic material exhibits a remanence ($B_r$) value of from about 6.5 kG to about 8.5 kG and an intrinsic coercivity ($H_{ci}$) value of from about 6.0 kOe to about 9.9 kOe.

In a specific embodiment, the step of rapidly solidifying comprises a melt-spinning or jet-casting process at a nominal wheel speed of from about 10 meter/second to about 60 meter/second. More specifically, the nominal wheel speed is less than about 20 meter/second when using a laboratory jet-caster, and from about 35 meter/second to about 45 meter/second under actual production conditions. Preferably, the actual wheel speed used in the melt-spinning or jet-casting process is within plus or minus 0.5%, 1.0%, 5.0%, 10%, 15%, 20%, 25% or 30% of the nominal wheel speed and that the nominal wheel speed is an optimum wheel speed of producing the magnetic material by the rapid solidification process, followed by the thermal annealing process.

Further, the various embodiments disclosed and/or discussed herein, such as the compositions of the magnetic material, rapid solidification processes, thermal annealing processes, compression processes, and magnetic properties of the magnetic material and the bonded magnet, are encompassed by the method.

EXAMPLE 1

Alloy ingots having compositions, in atomic percentage, of $R_2Fe_{14}B$, $R_2(Fe_{0.95}Co_{0.05})_{14}B$, and $(MM_{1-a}La_a)_{11.5}Fe_{82.5-v-w-x}Co_vZr_wAl_xB_{6.0}$, where R=Nd, Pr or $Nd_{0.75}Pr_{0.25}$ (represented by MM), were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table I lists the nominal composition, optimum wheel speed ($V_{ow}$) used for melt spinning, and the corresponding $B_r$, $H_{ci}$, and $(BH)_{max}$ values of powders prepared.

TABLE 1

| Nominal Composition (Formula Expression) | $V_{ow}$ m/s | $B_r$ kG | $H_{ci}$ kOe | $(BH)_{max}$ MGOe | Remarks |
|---|---|---|---|---|---|
| $Nd_2Fe_{14}B_1$ | 24.5 | 8.81 | 9.2 | 15.7 | Control |
| $Pr_2Fe_{14}B_1$ | 24.5 | 8.46 | 10.9 | 15.0 | Control |
| $(Nd_{0.75}Pr_{0.25})_2Fe_{14}B$ | 24.5 | 8.60 | 9.2 | 14.6 | Control |
| $Nd_2(Fe_{0.95}Co_{0.05})_{14}B$ | 24.5 | 8.87 | 8.7 | 15.7 | Control |
| $Pr_2(Fe_{0.95}Co_{0.05})_{14}B$ | 24.5 | 8.59 | 9.6 | 14.9 | Control |
| $(Nd_{0.75}Pr_{0.25})_2(Fe_{0.95}Co_{0.05})_{14}B$ | 24.7 | 8.66 | 9.1 | 13.7 | Control |
| $(MM_{0.50}La_{0.50})_{12.5}Fe_{78.9}Si_{2.4}Zr_{0.3}B_{5.9}$ | 19.5 | 7.51 | 7.1 | 10.7 | This Invention |
| $(MM_{0.65}La_{0.35})_{11.5}Fe_{75.8}Co_{2.5}Zr_{0.5}Al_{3.8}B_{5.9}$ | 18.0 | 7.57 | 7.1 | 11.4 | This Invention |
| $(MM_{0.63}La_{0.37})_{11.5}Fe_{75.8}Co_{2.5}Zr_{0.5}Al_{3.8}B_{5.9}$ | 18.0 | 7.41 | 7.2 | 10.5 | This Invention |
| $(MM_{0.57}La_{0.43})_{11.5}Fe_{76.6}Co_{2.5}Zr_{0.5}Al_{3.0}B_{5.9}$ | 17.7 | 7.53 | 6.6 | 10.4 | This Invention |
| $(MM_{0.61}La_{0.39})_{11.5}Fe_{76.5}Co_{2.5}Zr_{0.5}Al_{3.1}B_{5.9}$ | 17.5 | 7.61 | 6.8 | 11.2 | This Invention |
| $(MM_{0.62}La_{0.38})_{11.5}Fe_{76.4}Co_{2.5}Zr_{0.5}Al_{3.2}B_{5.9}$ | 17.7 | 7.61 | 7.0 | 11.4 | This Invention |
| $(MM_{0.62}La_{0.38})_{11.5}Fe_{76.1}Co_{2.5}Zr_{0.5}Al_{3.5}B_{5.9}$ | 17.8 | 7.54 | 7.1 | 11.2 | This Invention |
| $(MM_{0.63}La_{0.37})_{11.5}Fe_{79.1}Zr_{0.5}Al_{3.0}B_{5.9}$ | 17.5 | 7.63 | 7.1 | 11.5 | This Invention |
| $(MM_{0.64}La_{0.36})_{11.5}Fe_{78.6}Zr_{0.5}Al_{3.5}B_{5.9}$ | 17.5 | 7.47 | 7.1 | 10.9 | This Invention |
| $(MM_{0.63}La_{0.37})_{11.5}Fe_{78.8}Zr_{0.5}Al_{3.3}B_{5.9}$ | 17.7 | 7.50 | 7.1 | 11.1 | This Invention |
| $(MM_{0.62}La_{0.38})_{11.5}Fe_{78.95}Zr_{0.5}Al_{3.2}B_{5.9}$ | 17.5 | 7.54 | 7.1 | 11.2 | This Invention |

As can be seen, the control materials with stoichiometric $R_2Fe_{14}B$ or $R_2(Fe_{0.95}CO_{0.05})_{14}B$ compositions, where R=Nd, PR or MM, exhibit $B_r$ and $H_{ci}$ values of more than 8 kG and 7.5 kOe, respectively. Because of these high values, they are not suitable for making bonded magnets to directly replace anisotropic sintered ferrites. Moreover, the optimum wheel speed $V_{ow}$ required for melt spinning or jet casting is around 24.5 m/s, indicating they are not highly quenchable. In contrast, materials of the present invention, with appropriate additions of La, Zr, Al, or Co combination, exhibit $B_r$ and $H_{ci}$ values of 7.5±0.5 kG and $H_{ci}$ of 7±0.5 kOe. Furthermore, a significant reduction in $V_{ow}$ (24.5 to 17.5 m/s) can be obtained by the modified alloy compositions. As discussed herein, these reductions in $V_{ow}$ represent simplified processing control for melt spinning or jet casting.

EXAMPLE 2

Alloy ingots having compositions, in atomic percentage, of $Nd_xFe_{100-x-y}B_y$, where x=10 to 10.5 and y=9 to 11.5, and $(MM_{1-a}La_a)_{11.5}Fe_{82.6-w-x}Zr_wAl_xB_{5.9}$, where a =0.35 to 0.38, w=0.3 to 0.5 and x=3.0 to 3.5, were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table II lists the nominal composition, optimum wheel speed ($V_{ow}$) used for melt spinning, and the corresponding $B_r$, $M_d$(−3 kOe), $M_d/B_r$ ratio, $H_{ci}$, and $(BH)_{max}$ values of powders prepared.

TABLE II

| Nominal Composition | $B_r$ kG | $M_d$ (−3kOe) kG | $M_d/B_r$ | $H_c$ kOe | $H_{ci}$ kOe | $(BH)_{max}$ MGOe | Remarks |
|---|---|---|---|---|---|---|---|
| $Nd_{10.5}Fe_{80.5}B_9$ | 8.22 | 7.03 | 0.86 | 5.5 | 8.6 | 12.1 | Control |
| $Nd_{10}Fe_{81}B_9$ | 8.58 | 7.44 | 0.87 | 5.4 | 7.1 | 13.3 | Control |
| $Nd_{10}Fe_{80}B_{10}$ | 8.05 | 6.49 | 0.81 | 4.8 | 7.2 | 10.7 | Control |
| $Nd_{10}Fe_{79}B_{11}$ | 7.64 | 6.08 | 0.80 | 4.7 | 7.1 | 9.6 | Control |
| $Nd_{10}Fe_{78.5}B_{11}$ | 7.54 | 6.02 | 0.80 | 4.7 | 6.9 | 9.4 | Control |
| $Nd_{10}Fe_{78.5}B_{11.5}$ | 7.45 | 5.70 | 0.77 | 4.5 | 6.7 | 8.8 | Control |
| $Nd_{10}Fe_{78.5}B_{11.5}$ | 7.58 | 5.99 | 0.79 | 4.7 | 6.8 | 9.4 | Control |
| $Nd_{10.1}Fe_{78.5}B_{11.4}$ | 7.51 | 5.90 | 0.79 | 4.6 | 6.9 | 9.2 | Control |
| $Nd_{10.2}Fe_{78.5}B_{11.3}$ | 7.63 | 6.22 | 0.82 | 4.8 | 7.0 | 9.9 | Control |
| $(MM_{0.65}La_{0.35})_{11.5}Fe_{78.8}Al_{3.5}Zr_{0.3}B_{5.9}$ | 7.39 | 6.53 | 0.88 | 5.3 | 6.9 | 10.6 | This Invention |
| $(MM_{0.63}La_{0.37})_{11.5}Fe_{79.1}Al_{3.0}Zr_{0.5}B_{5.9}$ | 7.63 | 6.84 | 0.90 | 5.7 | 7.1 | 11.5 | This Invention |
| $(MM_{0.64}La_{0.36})_{11.5}Fe_{78.6}Al_{3.5}Zr_{0.5}B_{5.9}$ | 7.47 | 6.63 | 0.89 | 5.5 | 7.1 | 10.9 | This Invention |
| $(MM_{0.63}La_{0.37})_{11.5}Fe_{78.8}Al_{3.3}Zr_{0.5}B_{5.9}$ | 7.50 | 6.71 | 0.89 | 5.6 | 7.1 | 11.1 | This Invention |
| $(MM_{0.62}La_{0.38})_{11.5}Fe_{78.9}Al_{3.2}Zr_{0.5}B_{5.9}$ | 7.54 | 6.74 | 0.89 | 5.6 | 7.1 | 11.2 | This Invention |

Although $B_r$ and $H_{ci}$ values of 7.5±0.5 kG and 7.0±0.5 kOe can be achieved with compositions of $Nd_xFe_{100-x-y}B_y$, where x=10 to 10.5 and y=9 to 11.5 (the controls), a significant difference in demagnetization curve squareness can be noticed. In this example, $M_d$(−3 kOe) represents the magnetization measured on the powder at a applied field of −3 kOe. The higher the $M_d$(−3 kOe) value, the squarer the demagnetization curve is. Thus, it is desirable to have high $M_d$(−3 kOe) values. The ratio of $M_d$(−3 kOe)/$B_r$ can also be used as an indication of demagnetization curve squareness. Because of the improvement in squareness (0.77 to 0.82 of controls and 0.88 to 0.90 of this invention), the $(BH)_{max}$ values of powder of this invention are consequently higher than that of the controls (10.6 to 11.2 MGOe of this invention versus 8.8 to 9.6 MGOe of controls).

EXAMPLE 3

Alloy ingots having compositions, in atomic percentage, of $(MM_{1-a}La_a)_{11.5}Fe_{82.6-w-x}Zr_wAl_xB_{5.9}$, were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table III lists the nominal La, Zr, and Al contents, optimum wheel speed ($V_{ow}$) used for melt spinning, and the corresponding $B_r$, $H_c$, $H_{ci}$, and $(BH)_{max}$ values of powders prepared.

TABLE III

| La a | Zr w | Al x | $V_{ow}$ m/s | $B_r$ kG | $H_c$ kOe | $H_{ci}$ kOe | $(BH)_{max}$ MGOe | Remarks |
|---|---|---|---|---|---|---|---|---|
| 0.35 | 0.0 | 0.0 | 24.0 | 8.30 | 5.1 | 6.7 | 11.4 | Control |
| 0.30 | 0.0 | 1.9 | 21.2 | 7.83 | 5.0 | 6.8 | 11.3 | Control |
| 0.26 | 0.0 | 3.3 | 20.1 | 7.60 | 5.2 | 7.0 | 11.0 | Control |
| 0.45 | 0.4 | 0.0 | 20.3 | 7.96 | 5.6 | 7.3 | 11.7 | Control |
| 0.35 | 0.3 | 3.5 | 20.2 | 7.39 | 5.3 | 6.9 | 10.6 | This Invention |
| 0.36 | 0.5 | 3.5 | 17.5 | 7.47 | 5.5 | 7.1 | 10.9 | This Invention |
| 0.37 | 0.5 | 3.3 | 17.7 | 7.50 | 5.6 | 7.1 | 11.1 | This Invention |
| 0.38 | 0.5 | 3.2 | 17.5 | 7.54 | 5.6 | 7.1 | 11.2 | This Invention |

Table 3 lists the La, Zr, and Al contents and optimum wheel speed ($V_{ow}$) used for producing $(MM_{1-a}La_a)_{11.5}Fe_{82.6-w-x}Zr_wAl_xB_{5.9}$ and the corresponding $B_r$, $H_c$, $H_{ci}$, and $(BH)_{max}$ values. Although all of them exhibit $B_r$ values of around 7.5±0.2 kG and $H_{ci}$ values of around 7±0.1 kOe, it can clearly be seen that the $V_{ow}$ decreases with increasing Zr and Al contents. This decrease in $V_{ow}$ represents an advantage in melt spinning or jet casting as a lower wheel speed can be used to produce powder of the same quality. A lower wheel speed usually means the process is more controllable. It can also be observed that $B_r$ and $H_{ci}$ values of about 7.5 kG and 7.0 kOe can be achieved in many ways. For example, at Zr=0.5 at %, when the La content (a) is increased from 0.36 to 0.38, nearly identical $B_r$ and $H_{ci}$ values can be obtained by decreasing the Al content (x) from 3.5 to 3.2 at %. By varying the La and Al contents and their combinations, alloy designers can actually use two relatively independent variables to control the $V_{ow}$, $B_r$, and $H_{ci}$ values in desired combinations.

EXAMPLE 4

Alloy ingots having compositions, in atomic percentage, of $(MM_{1-a}La_a)_{11.5}Fe_{82.6-w-x}Zr_wSi_xB_{5.9}$, were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table IV lists the nominal La, Zr, and Si contents, optimum wheel speed ($V_{ow}$) used for melt spinning, and the corresponding $B_r$, $H_{ci}$, and $(BH)_{max}$ values of powders prepared.

TABLE IV

| La a | Zr w | Si x | $V_{ow}$ | $B_r$ kG | $H_c$ kOe | $H_{ci}$ kOe | $(BH)_{max}$ MGOe | Remarks |
|---|---|---|---|---|---|---|---|---|
| 0.40 | 0.0 | 0.0 | 24.5 | 7.96 | 5.2 | 7.5 | 10.5 | Control |
| 0.30 | 0.0 | 1.9 | 19.0 | 8.07 | 5.6 | 7.3 | 12.2 | Control |
| 0.45 | 0.4 | 0.0 | 20.3 | 7.96 | 5.6 | 7.3 | 11.7 | Control |
| 0.41 | 0.4 | 2.3 | 18.5 | 7.56 | 5.6 | 7.0 | 11.3 | This Invention |
| 0.54 | 0.4 | 2.4 | 18.3 | 7.45 | 5.3 | 6.5 | 10.7 | This Invention |

As can be seen, the $V_{ow}$ decreases with increasing Zr and Si contents. For example, a $V_{ow}$ of 24.5 m/s is required to prepare an optimum quench on a composition without any Zr or Si addition. The $V_{ow}$ decreases from 24.5 to 20.3 m/s with a 0.4 at % Zr addition, and from 24.5 m/s to 19.0 m/s with a 1.9 at % Si addition. A combination of 0.4 at % Zr with a 2.3 at % Si addition can further bring down the $V_{ow}$ to 18.5 m/s. As demonstrated, within these composition ranges, isotropic powders with $B_r$ values of 7.5±0.5 kG and $H_{ci}$ values of 7+0.5 kOe can readily be obtained at $V_{ow}$ of less than 20 m/s.

EXAMPLE 5

Alloy ingots having compositions, in atomic percentage, of $(R_{1-a}La_a)_{11.5}Fe_{82.5-x}Mn_xB_{6.0}$, where R=Nd or MM ($Nd_{0.75}Pr_{0.25}$) were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table V lists the nominal La and Mn contents and the corresponding $B_r$, $M_d$(−3 kOe), $H_c$, $H_{ci}$, and $(BH)_{max}$ values of powders prepared.

TABLE V

| La a | Mn x | $B_r$ kG | $M_d$(−3kOe) kG | $H_c$ kOe | $H_{ci}$ kOe | $(BH)_{max}$ MGOe | Remarks |
|---|---|---|---|---|---|---|---|
| 0.3* | 0.0 | 8.38 | 7.13 | 5.3 | 7.0 | 12.4 | Control |
| 0.3* | 1.0 | 7.92 | 6.75 | 5.2 | 6.9 | 11.4 | Control |
| 0.3* | 2.0 | 7.48 | 6.42 | 5.0 | 6.8 | 10.4 | This Invention |
| 0.3* | 3.0 | 7.10 | 6.16 | 4.9 | 6.8 | 9.6 | This Invention |
| 0.3* | 4.0 | 6.71 | 5.89 | 4.8 | 6.8 | 8.9 | Control |
| 0.3* | 2.0 | 7.48 | 6.42 | 5.0 | 6.8 | 10.4 | This Invention |
| 0.28* | 2.0 | 7.55 | 6.61 | 5.3 | 7.0 | 10.9 | This Invention |
| 0.3** | 1.7 | 7.75 | 6.74 | 5.4 | 7.0 | 11.3 | This Invention |
| 0.3** | 1.9 | 7.54 | 6.53 | 5.0 | 6.6 | 10.7 | This Invention |

Note:
*R = MM = ($Nd_{0.75}Pr_{0.25}$)
**R = Nd

As can be seen, without any Mn addition, a $B_r$ value of 8.38 kG was obtained on $(R_{0.7}La_{0.3})_{11.5}Fe_{82.5}B_{6.0}$. This value is too high for direct anisotropic sintered ferrite replacement. Similarly, when Mn was increased to 4 at %, a $B_r$ of 6.71 kG was obtained. This value is too low for direct anisotropic sintered ferrite replacement. The Mn content needs to be within a certain range to obtain desired $B_r$ values for direct sintered ferrite replacement. Moreover, when comparing the two compositions with constant Mn content of 2 at % (x=2), $H_{ci}$ values of 7.8 and 7.0 kOe can be obtained by adjusting the La content (a) from 0.30 and 0.28, respectively. This slight decrease in La content also increases the $B_r$ values from 7.48 to 7.55 kG. This demonstrates that two independent variables, namely La and Mn, can be used to simultaneously adjust the $B_r$ and $H_{ci}$ values of powders. In this case, Mn would be the independent variable to adjust the $B_r$ values and La is used to control $H_{ci}$ Values. The impact of La to $B_r$ is a secondary effect and can be neglected when compared to the dominant effect arising from Mn.

EXAMPLE 6

Alloy ingots having compositions, in atomic percentage, of $(MM_{0.65}La_{0.35})_{11.5}Fe_{82.5-w-x}Nb_wMn_xB_{6.0}$ were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table VI lists the Nb and Si contents, optimum wheel speed ($V_{ow}$) used for melt spinning, and the corresponding $B_r$, $M_d$(−3 kOe), $H_{ci}$, and $(BH)_{max}$ values of powders prepared.

TABLE VI

| Nb w | Si x | $V_{ow}$ m/s | $B_r$ kG | $M_d$(−3kOe) kG | $H_c$ kOe | $H_{ci}$ kOe | $(BH)_{max}$ MGOe | Remarks |
|---|---|---|---|---|---|---|---|---|
| 0.0 | 0.0 | 24.0 | 8.30 | 6.76 | 5.1 | 6.7 | 11.4 | Control |
| 0.2 | 0.0 | 20.0 | 8.15 | 6.80 | 4.9 | 6.8 | 11.5 | Control |
| 0.3 | 0.0 | 19.0 | 8.24 | 6.91 | 5.4 | 7.1 | 11.8 | Control |
| 0.3 | 3.6 | 18.0 | 7.53 | 6.77 | 5.4 | 7.3 | 11.3 | This Invention |
| 0.2 | 3.8 | 19.0 | 7.46 | 6.67 | 5.2 | 7.0 | 11.0 | This Invention |
| 0.2 | 3.7 | 18.0 | 7.62 | 6.76 | 5.3 | 7.3 | 11.3 | This Invention |

As can be seen, 0.2 at % of Nb addition decreases the $V_{ow}$ from 24 to 20 m/s. A further increase in Nb content from 0.2 to 0.3 at % brings the $V_{ow}$ to 19 m/s. This demonstrates that Nb is very effective in reducing $V_{ow}$. However, $B_r$ values of 8.15 and 8.24 kG were obtained when the Nb contents are at 0.2 and 0.3 at %, without any Si addition. The $B_r$ values of isotropic bonded magnets made from these powders would be too high for direct anisotropic sintered ferrite replacement. Nb addition by itself is insufficient to bring both $B_r$ and $H_{ci}$ values to the desired ranges of 7.5±0.5 kG and 7.0±0.5 kOe, respectively. In this case, about 3.6 to 3.8 at % of Si is needed to bring both $B_r$ and $H_{ci}$ values into desirable ranges. Si addition at these levels also lowers the $V_{ow}$ from 19–20 to 18–19 m/s, a moderate but secondary improvement in quenchability.

EXAMPLE 7

Alloy ingots having compositions, in atomic percentage, of $(MM_{0.65}La_{0.35})_{11.5}Fe_{82.5-w-x}M_wSi_xB_{6.0}$ were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table VII lists the nominal composition, optimum wheel speed ($V_{ow}$) used for melt spinning, and the corresponding $B_r$, $M_d$(−3 kOe), $M_d/B_r$ ratio, $H_{ci}$ and $(BH)_{max}$ values of powders prepared.

TABLE VII

| M w | Si x | $B_r$ kG | $M_d$(−3kOe) kG | $M_d/B_r$ | $H_c$ kOe | $H_{ci}$ kOe | $(BH)_{max}$ MGOe | Remarks |
|---|---|---|---|---|---|---|---|---|
| | | | | M = Nb | | | | |
| 0.2 | 0 | 8.15 | 6.80 | 0.83 | 4.9 | 6.8 | 11.5 | Control |
| 0.3 | 0 | 8.24 | 6.91 | 0.84 | 5.4 | 7.1 | 11.8 | Control |

TABLE VII-continued

| M w | Si x | $B_r$ kG | $M_d$(−3kOe) kG | $M_d/B_r$ | $H_c$ kOe | $H_{ci}$ kOe | $(BH)_{max}$ MGOe | Remarks |
|---|---|---|---|---|---|---|---|---|
| 0.3 | 3.6 | 7.53 | 6.77 | 0.90 | 5.4 | 7.3 | 11.3 | This Invention |
| 0.2 | 3.8 | 7.46 | 6.67 | 0.89 | 5.2 | 7.0 | 11.0 | This Invention |
| 0.2 | 3.7 | 7.62 | 6.76 | 0.89 | 5.3 | 7.3 | 11.3 | This Invention |
| | | | | M = Zr | | | | |
| 0.5 | 0 | 8.35 | 7.37 | 0.88 | 5.8 | 7.3 | 13.1 | Control |
| 0.4 | 0 | 8.35 | 7.33 | 0.88 | 5.7 | 7.2 | 13.0 | Control |
| 0.5 | 3.6 | 7.63 | 6.81 | 0.89 | 5.6 | 7.3 | 11.4 | This Invention |
| 0.4 | 4.1 | 7.61 | 6.88 | 0.90 | 5.6 | 7.1 | 11.6 | This Invention |
| 0.4 | 4.5 | 7.50 | 6.76 | 0.90 | 5.5 | 7.0 | 11.3 | This Invention |
| | | | | M = Cr | | | | |
| 1.3 | 0 | 7.91 | 6.59 | 0.83 | 5.2 | 7.1 | 10.9 | This Invention |
| 1.3 | 2 | 7.23 | 6.15 | 0.85 | 4.9 | 6.9 | 9.6 | This Invention |
| 1.4 | 1.1 | 7.57 | 6.50 | 0.86 | 5.2 | 7.2 | 10.6 | This Invention |
| 1.3 | 1.2 | 7.55 | 6.48 | 0.86 | 5.0 | 7.0 | 10.6 | This Invention |

In this example, it is demonstrated that Nb, Zr, or Cr can all be used in combination with Si to bring $B_r$ and $H_{ci}$ to desired ranges. Because of the differences in the atomic radii, the desired amount of Nb, Zr, or Cr varies from 0.2–0.3 to 0.4–0.5 and 1.3–1.4 at % for Nb, Zr, and Cr, respectively. The optimum amount of Si also needs to be adjusted accordingly. In other words, for each pair of M and T, there is a set of w and x combinations to meet the targets for $B_r$ and $H_{ci}$. This also suggests that $B_r$ and $H_{ci}$ values can be independently adjusted to the desired ranges with certain degree of freedom. Based on these results, the $M_d/B_r$ ratio decreases in the order of Zr, Nb, and Cr. This suggests that Zr is the preferable refractory element compared to Nb or Cr if one looks for the best demagnetization curve squareness.

EXAMPLE 8

Alloy ingots having compositions, in atomic percentage, of $(MM_{1-a}La_a)_{11.5}Fe_{82.5-v-w-x}Co_vZr_wAl_xB_{6.0}$ were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table VIII lists the La, Co, Zr, and Al contents, optimum wheel speed ($V_{ow}$) used for melt spinning, and the corresponding $B_r$, $H_{ci}$, and $(BH)_{max}$ values of powders prepared.

TABLE VIII

| La a | Co v | Zr w | Al x | $V_{ow}$ | $B_r$ kG | $H_{ci}$ kOe | $(BH)_{max}$ MGOe | $T_c$ | Remarks |
|---|---|---|---|---|---|---|---|---|---|
| 0.00 | 0.0 | 0.0 | 0.0 | 24.5 | 8.60 | 9.2 | 14.6 | 307 | Control |
| 0.26 | 2.0 | 0.3 | 3.5 | 20.0 | 7.67 | 7.8 | 11.9 | 303 | This Invention |

TABLE VIII-continued

| La a | Co v | Zr w | Al x | $V_{ow}$ | $B_r$ kG | $H_{ci}$ kOe | $(BH)_{max}$ MGOe | $T_c$ | Remarks |
|---|---|---|---|---|---|---|---|---|---|
| 0.35 | 2.5 | 0.5 | 3.8 | 18.0 | 7.57 | 7.1 | 11.4 | 302 | This Invention |
| 0.37 | 2.5 | 0.5 | 3.8 | 18.0 | 7.41 | 7.2 | 10.5 | 302 | This Invention |
| 0.43 | 2.5 | 0.5 | 3.0 | 17.7 | 7.53 | 6.6 | 10.4 | 301 | This Invention |
| 0.39 | 2.5 | 0.5 | 3.1 | 17.5 | 7.61 | 6.8 | 11.2 | 302 | This Invention |
| 0.38 | 2.5 | 0.5 | 3.2 | 17.7 | 7.61 | 7.0 | 11.4 | 302 | This Invention |
| 0.38 | 2.5 | 0.5 | 3.5 | 17.8 | 7.54 | 7.1 | 11.2 | 303 | This Invention |

In this example, it is demonstrated that La, Co, Zr, and Al can be combined in various ways to obtain melt spun powders with $B_r$ and $H_{ci}$ in the ranges of 7.5±0.5 kG and 7.0±0.5 kOe, respectively. More specifically, La, Al, Zr, and Co are incorporated to adjust $H_{ci}$, $B_r$, $V_{ow}$, and $T_c$ of these alloy powders. They can all be adjusted in various combinations to obtain the desired $B_r$, $H_{ci}$, $V_{ow}$, or $T_c$.

EXAMPLE 9

Alloy ingots having compositions, in atomic percentage, of $(MM_{1-a}La_a)_{11.5}Fe_{82.6-w-x}Nb_wAl_xB_{5.9}$ were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Since $B_r$ and $H_{ci}$ values of bonded magnets usually depend on the type and amount of binder plus additives used, their properties can be scaled within certain ranges. Therefore, it is more convenient if one uses powder properties to compare performance. Table IX lists the La, Nb, and Al contents, optimum wheel speed ($V_{ow}$) used for melt spinning, and the corresponding $B_r$, $H_{ci}$, and $(BH)_{max}$ values of powders prepared.

TABLE IX

| La a | Nb w | Al x | $V_{ow}$ m/s | $B_r$ kG | $H_c$ kOe | $H_{ci}$ kOe | $(BH)_{max}$ MGOe | Remarks |
|---|---|---|---|---|---|---|---|---|
| 0.00 | 0.00 | 0.00 | 24.5 | 8.60 | 6.2 | 9.2 | 14.6 | Control |
| 0.30 | 0.00 | 0.00 | 24.0 | 8.39 | 5.4 | 7.0 | 12.7 | Control |
| 0.35 | 0.00 | 0.00 | 24.0 | 8.30 | 5.1 | 6.7 | 11.4 | Control |
| 0.35 | 0.00 | 0.00 | 24.0 | 8.33 | 5.0 | 6.6 | 11.3 | Control |
| 0.35 | 0.50 | 0.00 | 20.0 | 8.30 | 5.2 | 7.2 | 11.6 | Control |
| 0.40 | 0.50 | 0.00 | 19.0 | 8.24 | 5.5 | 7.1 | 12.1 | Control |
| 0.50 | 0.50 | 0.00 | 18.0 | 7.59 | 4.8 | 6.3 | 9.4 | Control |
| 0.37 | 0.50 | 2.20 | 17.0 | 7.53 | 5.7 | 7.8 | 11.0 | This Invention |
| 0.40 | 0.30 | 2.20 | 18.0 | 7.56 | 5.2 | 6.8 | 10.8 | This Invention |
| 0.37 | 0.30 | 2.40 | 20.0 | 7.49 | 4.9 | 6.6 | 10.9 | This Invention |
| 0.37 | 0.35 | 2.35 | 21.0 | 7.67 | 5.2 | 7.0 | 11.2 | This Invention |
| 0.38 | 0.37 | 2.63 | 21.4 | 7.46 | 5.1 | 6.9 | 10.7 | This Invention |

This example demonstrates that with various La additions, one can bring the $H_{ci}$ from 9.2 kOe of $MM_{11.5}Fe_{83.6}B_{5.9}$ to the range of 7.0±0.5 kOe. Also, La-addition has limited impact to $V_{ow}$. With 0.5 at % Nb addition, a slight increase in $H_{ci}$ (from 6.6 to 7.2 kOe) can be noticed at the cost of $B_r$ (from 8.33 to 8.30 kG). More importantly, the $V_{ow}$ decreases from 24 for the Nb-free sample to 20 m/s for a sample containing 0.5 at % Nb, indicating an improvement in alloy quenchability. With about 2.2 to 2.4 at % Al addition, one can readily bring the $B_r$ to the desire range of 7.5±0.5 kG. At Al levels of 2.2 to 2.4 at %, reduction in Nb content can still maintain the desired $B_r$ and $H_{ci}$ in the range of 7.5±0.5 kG and 7.0±0.5 kOe, respectively. However, the $V_{ow}$ increases slightly from 17 to 21 m/s. This suggests that Nb is critical to the alloy quenchability. With appropriate La, Nb, and Al combination, this example demonstrates that one can essentially adjust the $B_r$, $H_{ci}$, and $V_{ow}$ independently to certain degree.

EXAMPLE 10

Alloy ingots having compositions, in atomic percentage, of $(MM_{1-a}La_a)Fe_{94.1-u-x-w}Co_vZr_wAl_xB_{5.9}$ were prepared by induction melting. A production jet caster with a metallic wheel of good thermal conductivity was used for jet casting. A wheel speed of 30 to 45 meter/second (m/s) was used to prepare the sample. Jet-cast ribbons were crushed to less than 40 mesh and annealed at a temperature rage of 600 to 800° C. for about 30 minutes to develop the desired $B_r$ and $H_{ci}$. Since $B_r$ and $H_{ci}$ of bonded magnets usually depend on the type and amount of binder plus additives used, their properties can be scaled with certain ranges. Therefore, it is more convenient if one uses powder properties to compare performance. Table X lists the La, Zr, Al, and total rare earth content (u), optimum wheel speed ($V_{ow}$) used for jet casting, and the corresponding $B_r$, $H_{ci}$, and $(BH)_{max}$ values of powders prepared.

TABLE X

| La a | Zr w | Al x | TRE u | $V_{ow}$ m/s | $B_r$ kG | $H_{ci}$ kOe | $(BH)_{max}$ MGOe | Remark |
|---|---|---|---|---|---|---|---|---|
| — | — | 0.02 | 11.8 | 46 | 8.90 | 9.10 | 15.51 | Control |
| — | — | 0.03 | 12.1 | 45 | 8.75 | 10.0 | 15.08 | Control |
| 0.01 | 0.01 | 0.93 | 11.1 | 43 | 8.49 | 8.52 | 14.33 | This Invention |
| 0.01 | 0.01 | 1.02 | 11.2 | 42 | 8.42 | 8.57 | 13.95 | This Invention |
| 0.01 | 0.01 | 1.49 | 11.3 | 41 | 8.36 | 8.90 | 13.95 | This Invention |
| 0.01 | 0.01 | 1.86 | 11.6 | 41 | 8.10 | 10.25 | 13.45 | This Invention |
| 0.01 | 0.01 | 2.35 | 11.0 | 41 | 8.26 | 8.67 | 13.45 | This Invention |
| 0.01 | 0.01 | 2.61 | 11.4 | 41 | 7.95 | 9.20 | 12.82 | This Invention |
| 0.01 | 0.01 | 2.79 | 11.3 | 40 | 7.81 | 9.11 | 12.32 | This Invention |

This example demonstrates that, with various Al additions, one can manipulate the $B_r$ values of magnetic powders with the general formula of $(MM_{1-a}La_a)_uFe_{94.1-u-x-v-w}Co_vZr_wAl_xB_{5.9}$ to between about 7.8 and 8.5 kG. In conjunction with the Al control, one can also manipulate the $H_{ci}$ values between 8.5 and 10.25 kOe by adjusting the total rare earth (TRE) content. With a very dilute La and Zr addition, the optimum wheel speeds also decreases to about 40 to 43 m/s when compared to the 45–46 m/s of alloys without any La, Zr or Al additions. This suggests that a dilute La and Zr addition improves the quenchability. The lower $V_{ow}$ also is an indication of improved quenchability.

EXAMPLE 11

Alloy ingots having a composition, in atomic percentage, of $(MM_{0.62}La_{0.38})_{11.5}Fe_{78.9}Zr_{0.5}Al_{3.2}B_{5.9}$ were prepared by arc melting. A laboratory jet caster wiht a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Epoxy-bonded magnets were prepared by mixing the powder with 2 wt % epoxy and 0.02 wt % zinc stearate and dry-blended for about 30 minutes. The mixed compound was then compression-molded in air with a compression pressure of about 4 T/cm$^2$ to form magnets with diameters of about 9.72 mm and with a permeance coefficient of 2 (PC=2). They were then cured at 175° C. for 30 minutes to form thermoset epoxy-bonded magnets. PA-11 and PPS bonded magnets were prepared by mixing Polyamide PA-11 or Polyphenylene Sulfide (PPS) resins with internal lubricants at powder volume fractions of 65 and 60 vol %, respectively. These mixtures were then compounded at temperatures of 280 and 310° C., to form Polyamide PA-11 and PPS based compounds, respectively. The compounds were then injection molded in a steel mold to obtain magnets with diameters of about 9.72 mm and with a permeance coefficient of 2 (PC=2). All magnets were pulse magnetized with a peak magnetizing field of 40 kOe prior to measurement. A hysteresis graph with a temperature stage was used to measure the magnet properties at 20 and 100° C. Table XI lists the volume fraction of epoxy, Polyamide PA-11, and PPS in bonded magnets and their corresponding $B_r$, $H_{ci}$, and $(BH)_{max}$ values, measured at 20 and 100° C.

TABLE XI

| | Volume Fraction vol % | $B_r$ kG | $H_c$ kOe | $H_{ci}$ kOe | $BH_{max}$ MGOe | Remarks |
|---|---|---|---|---|---|---|
| | | Measured at 20° C. | | | | |
| Anisotropic Sintered Ferrite | >99 | 4.50 | 4.08 | 4.50 | 5.02 | Control |
| Isotropic Powder | | 7.55 | 5.49 | 7.10 | 11.22 | This Invention |
| Epoxy Bonded Magnet | 75% | 5.69 | 5.04 | 7.05 | 6.71 | This Invention |
| PA-11 Bonded Magnet | 65% | 4.93 | 4.44 | 7.04 | 5.13 | This Invention |
| PPS Bonded Magnet | 60% | 4.55 | 4.13 | 7.04 | 4.39 | This Invention |
| | | Measured at 100° C. | | | | |
| Anisotropic Sintered Ferrite | >99 | 3.78 | 3.84 | 5.94 | 3.53 | Control |
| Isotropic Powder | | 6.67 | 4.11 | 4.77 | 8.13 | This Invention |
| Epoxy Bonded Magnet | 75 | 5.00 | 3.71 | 4.77 | 4.95 | This Invention |
| PA-11 Bonded Magnet | 65 | 4.34 | 3.40 | 4.77 | 3.81 | This Invention |
| PPS Bonded Magnet | 60 | 4.00 | 3.21 | 4.77 | 3.31 | This Invention |

As can be seen, isotropic bonded magnets with volume fractions ranging from 60 to 75 vol % exhibit $B_r$ values of 4.55 to 5.69 kG at 20° C. These values are all higher than that of the anisotropic sintered ferrite (the control). Similarly, the $H_c$ of these magnets range from 4.13 to 5.04 kOe at 20° C. Again, they are all higher than the competitive anisotropic sintered ferrite. High $B_r$ and $H_c$ values mean a more energy efficient application can be designed using isotropic bonded magnets of this invention. At 100° C., the $B_r$ of isotropic bonded magnets ranges from 4.0 to 5.0 kG. They are all higher than the 3.78 kG of anisotropic sintered ferrite. At this temperature range, the $H_c$ of isotropic bonded magnets varies from 3.21 to 4.11 kOe. These values are comparable to that of anisotropic sintered ferrite. Similarly, the $(BH)_{max}$ of bonded magnets are around 3.31 to 4.95 MGOe and comparable to that of anisotropic sintered ferrite at the same temperature. Again, this demonstrates that a more energy efficiency application can be designed using isotropic bonded magnets of this invention.

EXAMPLE 12

Alloy ingots having nominal composition, in atomic percentage (formula expression), of $(MM_{0.62}La_{0.38})_{11.5}Fe_{78.9}Zr_{0.5}Al_{3.2}B_{5.9}$ were prepared by arc melting. A laboratory jet caster with a metallic wheel of good thermal conductivity was used for melt-spinning. A wheel speed of 10 to 30 meter/second (m/s) was used to prepare the samples. Melt-spun ribbons were crushed to less than 40 mesh and annealed at a temperature in the range of 600 to 700° C. for about four minutes to develop the desired values of $B_r$ and $H_{ci}$. Epoxy-bonded magnets were prepared by mixing the powder prepared with 2 wt % epoxy and 0.02 wt % zinc stearate and dry-blended for about 30 minutes. The mixed compound was then compression-molded in air with a compression pressure of about 4 T/cm$^2$ at temperatures of 20, 80, 100, and 120° C. to form magnets with diameters of about 9.72 mm and with a permeance coefficient of 2 (PC=2). A hysteresis graph was used to measure the magnet properties at 20° C. Table XII lists the $B_r$, $H_{ci}$ and $(BH)_{max}$ values, measured at 20° C., of magnets prepared from powder with nominal composition of $(MM_{0.62}La_{0.38})_{11.5}Fe_{78.9}Zr_{0.5}Al_{3.2}B_{5.9}$.

TABLE XII

| | Volume Fraction Vol % | $B_r$ kG | $\Delta B_r$ kG | $B_r(T)/B_r(20)$ | $H_c$ kOe | $H_{ci}$ kOe | $BH_{max}$ MGOe | Remarks |
|---|---|---|---|---|---|---|---|---|
| Powder Properties | | 7.55 | | | 5.49 | 7.10 | 11.22 | |
| Pressed at 20° C. | 75.0 | 5.69 | 0.00 | 1.00 | 5.04 | 7.05 | 6.71 | Control |
| Pressed at 80° C. | 76.0 | 5.76 | 0.08 | 1.01 | 5.10 | 7.04 | 6.86 | This Invention |
| Pressed at 100° C. | 76.5 | 5.80 | 0.11 | 1.02 | 5.13 | 7.05 | 6.94 | This Invention |
| Pressed at 120° C. | 77.0 | 5.84 | 0.15 | 1.03 | 5.16 | 7.04 | 7.02 | This Invention |

As can be seen, compression molding at between 80 and 120° C. improves the $B_r$ values by approximately 1 to 3% $(B_r(T)/B_r(20)$ of 1.01 to 1.03 or $\Delta B_r$ of 0.08 to 0.15 kG), when compared to the control magnet pressed at 20° C. As a result, slight increases in $H_c$ (about 0.06 to 0.12 kOe or about 0.5 to 2% improvement) and $(BH)_{max}$ (approximately 1 to 5% improvement) can also be noticed. This demonstrates the advantages of employing warm compaction for making epoxy-bonded magnets.

The present invention has been described and explained generally, and also by reference to the preceding examples which describe in detail the preparation of the magnetic powders and the bonded magnets of the present invention. The examples also demonstrate the superior and unexpected properties of the magnets and magnetic powders of the present invention. The preceding examples are illustrative only and in no way limit the scope of the present invention. It will be apparent to those skilled in the art that many modifications, both to products and methods, may be practiced without departing from the purpose and scope of this invention.

What is claimed is:

1. A magnetic material having been prepared by a rapid solidification process, followed by a thermal annealing process, said magnetic material having the composition, in atomic percentage, of $$(R_{1-a}R'_a)_uFe_{100-u-v-w-x-y}Co_vM_wT_xB_y$$

wherein R is Nd, Pr, Didymium (a nature mixture of Nd and Pr at composition of $Nd_{0.75}Pr_{0.25}$), or a combination thereof; R' is La, Ce, Y, or a combination thereof; M is one or more of Zr, Nb, Ti, Cr, V, Mo, W, and Hf; and T is one or more of Al, Mn, Cu, and Si, wherein $0.01 \leqq a \leqq 0.8$, $7 \leqq u \leqq 13$, $0 \leqq v \leqq 20$, $0.01 \leqq w \leqq 1$, $0.1 \leqq x \leqq 5$, and $4 \leqq y \leqq 12$, and wherein the magnetic material exhibits a remanence ($B_r$) value of from about 6.5 kG to about 8.5 kG and an intrinsic coercivity ($H_{ci}$) value of from about 6.0 kOe to about 9.9 kOe.

2. The magnetic material of claim 1, wherein the rapid solidification process is a melt-spinning or jet-casting process with a nominal wheel speed of from about 10 meter/second to about 60 meter/second.

3. The magnetic material of claim 2, wherein the nominal wheel speed is from about 15 meter/second to about 50 meter/second.

4. The magnetic material of claim 2, wherein the nominal wheel speed is from about 35 meter/second to about 45 meter/second.

5. The magnetic material of claim 2, wherein an actual wheel speed is within plus or minus 0.5%, 1.0%, 5.0%, 10%, 15%, 20%, 25% or 30% of the nominal wheel speed.

6. The magnetic material of claim 2, wherein the nominal wheel speed is an optimum wheel speed for producing the magnetic material by the rapid solidification process, followed by the thermal annealing process.

7. The magnetic material of claim 1, wherein the thermal annealing process is at a temperature range of about 300° C. to about 800° C. for about 0.5 to about 120 minutes.

8. The magnetic material of claim 7, wherein the thermal annealing process is at a temperature range of about 600° C. to about 700° C. for about 2 to about 10 minutes.

9. The magnetic material of claim 1, wherein M is Zr, Nb, or a combination thereof and T is Al, Mn, or a combination thereof.

10. The magnetic material of claim 9, wherein M is Zr and T is Al.

11. The magnetic material of claim 1, wherein $0.2 \leqq a \leqq 0.6$, $10 \leqq u \leqq 13$, $0 \leqq v \leqq 10$, $0.1 \leqq w \leqq 0.8$, $2 \leqq x \leqq 5$, and $4 \leqq y \leqq 10$.

12. The magnetic material of claim 11, wherein $0.25 \leqq a \leqq 0.5$, $11 \leqq u \leqq 12$, $0 \leqq v \leqq 5$, $0.2 \leqq w \leqq 0.7$, $2.5 \leqq x \leqq 4.5$, and $5 \leqq y \leqq 6.5$.

13. The magnetic material of claim 12, wherein $0.3 \leqq a \leqq 0.45$, $11.3 \leqq u \leqq 11.7$, $0 \leqq v \leqq 2.5$, $0.3 \leqq w \leqq 0.6$, $3 \leqq x \leqq 4$, and $5.7 \leqq y \leqq 6.1$.

14. The magnetic material of claim 1, wherein $0.01 \leqq a \leqq 0.1$ and $0.1 \leqq x \leqq 1$.

15. The magnetic material of claim 1, wherein the magnetic material exhibits a $B_r$ value of from about 7.0 kG to about 8.0 kG and, independently, an $H_{ci}$ value of from about 6.5 kOe to about 9.9 kOe.

16. The magnetic material of claim 15, wherein the magnetic material exhibits a $B_r$ value of from about 7.2 kG to about 7.8 kG and, independently, an $H_{ci}$ value of from about 6.7 kOe to about 7.3 kOe.

17. The magnetic material of claim 15, wherein the magnetic material exhibits a $B_r$ value of from about 7.8 kG to about 8.3 kG and, independently, an $H_{ci}$ value of from about 8.5 kOe to about 9.5 kOe.

18. The magnetic material of claim 1, wherein the material exhibits a near stoichiometric $Nd_2Fe_{14}B$ type single-phase microstructure, as determined by X-Ray diffraction.

19. The magnetic material of claim 1, wherein the material has crystal grain sizes ranging from about 1 nm to about 80 nm.

20. The magnetic material of claim 19, wherein the material has crystal grain sizes ranging from about 10 nm to about 40 nm.

21. A bonded magnet comprising a magnetic material and a bonding agent, said magnetic material having been prepared by a rapid solidification process, followed by a thermal annealing process, said magnetic material having the composition, in atomic percentage, of $$(R_{1-a}R'_a)_u Fe_{100-u-v-w-x-y} Co_v M_w T_x B_y$$

wherein R is Nd, Pr, Didymium (a nature mixture of Nd and Pr at composition of $Nd_{0.75}Pr_{0.25}$), or a combination thereof; R' is La, Ce, Y, or a combination thereof; M is one or more of Zr, Nb, Ti, Cr, V, Mo, W, and Hf; and T is one or more of Al, Mn, Cu, and Si, wherein $0.01 \leqq a \leqq 0.8$, $7 \leqq u \leqq 13$, $0 \leqq v \leqq 20$, $0.01 \leqq w \leqq 1$, $0.1 \leqq x \leqq 5$, and $4 \leqq y \leqq 12$, and wherein the magnetic material exhibits a remanence ($B_r$) value of from about 6.5 kG to about 8.5 kG and an intrinsic coercivity ($H_{ci}$) value of from about 6.0 kOe to about 9.9 kOe.

22. The bonded magnet of claim 21, wherein the bonding agent is epoxy, polyamide (nylon), polyphenylene sulfide (PPS), a liquid crystalline polymer (LCP), or combinations thereof.

23. The bonded magnet of claim 22, wherein the bonding agent further comprises one or more additives selected from a high molecular weight multi-functional fatty acid ester, stearic acid, hydroxy stearic acid, a high molecular weight complex ester, a long chain ester of pentaerythritol, palmitic acid, a polyethylene based lubricant concentrate, an ester of montanic acid, a partly saponified ester of montanic acid, a polyolefin wax, a fatty bis-amide, a fatty acid secondary amide, a polyoctanomer with high trans content, a maleic anhydride, a glycidyl-functional acrylic hardener, zinc stearate, and a polymeric plasticizer.

24. The bonded magnet of claim 23, wherein the magnet comprises, by weight, from about 1% to about 5% epoxy and from about 0.01% to about 0.05% zinc stearate.

25. The bonded magnet of claim 24, wherein the magnet has a permeance coefficient or load line of from about 0.2 to about 10.

26. The bonded magnet of claim 25, wherein the magnet exhibits a flux-aging loss of less than about 6.0% when aged at 100° C. for 100 hours.

27. The bonded magnet of claim 21, wherein the magnet is made by compression molding, injection molding, calendering, extrusion, screen printing, or a combination thereof.

28. The bonded magnet of claim 27, wherein the magnet is made by compression molding at a temperature ranges of 40° C. to 200° C.

* * * * *